US008453344B2

(12) United States Patent
Nishiwaki et al.

(10) Patent No.: US 8,453,344 B2
(45) Date of Patent: Jun. 4, 2013

(54) SHOE SOLE WITH REINFORCING STRUCTURE AND SHOE SOLE WITH SHOCK-ABSORBING STRUCTURE

(75) Inventors: Tsuyoshi Nishiwaki, Kobe (JP); Toshikazu Kayano, Kobe (JP); Tomohiro Hayashi, Kobe (JP); Shuhei Takemura, Kobe (JP)

(73) Assignee: Asics Corporation, Irvine, CA (US)

( * ) Notice: Subject to any disclaimer, the term of this patent is extended or adjusted under 35 U.S.C. 154(b) by 1175 days.

(21) Appl. No.: 12/226,081

(22) PCT Filed: Apr. 21, 2006

(86) PCT No.: PCT/JP2006/308404

§ 371 (c)(1),
(2), (4) Date: Oct. 6, 2008

(87) PCT Pub. No.: WO2007/122722

PCT Pub. Date: Nov. 1, 2007

(65) Prior Publication Data

US 2009/0113758 A1 May 7, 2009

(51) Int. Cl.

| | |
|---|---|
| ***A43B 13/12*** | (2006.01) |
| ***A43B 13/18*** | (2006.01) |
| ***A43B 21/26*** | (2006.01) |
| ***A43B 23/00*** | (2006.01) |

(52) U.S. Cl.
USPC ..... 36/35 R; 36/28; 36/30 R; 36/103; 36/107

(58) Field of Classification Search
USPC ..... 36/92, 103, 707, 108, 27, 28, 30 R, 36/37, 38, 35 R, 31, 107
See application file for complete search history.

(56) References Cited

U.S. PATENT DOCUMENTS

| | | | | |
|---|---|---|---|---|
| 881,974 | A * | 3/1908 | Toporczer | 36/179 |
| 3,204,347 | A * | 9/1965 | Snow | 36/107 |
| 4,561,195 | A * | 12/1985 | Onoda et al. | 36/30 R |
| 4,922,631 | A | 5/1990 | Anderie | |
| 5,185,943 | A * | 2/1993 | Tong et al. | 36/28 |
| 6,216,365 | B1 * | 4/2001 | Cohen | 36/44 |
| 6,438,870 | B2 | 8/2002 | Nasako et al. | |
| 6,438,873 | B1 * | 8/2002 | Gebhard et al. | 36/114 |

(Continued)

FOREIGN PATENT DOCUMENTS

| | | |
|---|---|---|
| EP | 0278094 | 12/1987 |
| JP | 63-194602 | 8/1988 |

(Continued)

*Primary Examiner* — Jila M Mohandesi
*Assistant Examiner* — Sharon M Prange
(74) *Attorney, Agent, or Firm* — Mintz Levin Cohn Ferris Glovsky and Popeo, P.C.

(57) ABSTRACT

A shoe sole includes a mid sole, and a reinforcing member reinforcing a portion of the mid sole, wherein the member (2) extends over an area from a mid foot part (12) to a rear foot part (13), the member (2) including: a rod-shaped or strip-shaped main bar (21) provided along a line that is at the center of the foot; mid foot medial blades (22) and (23) and mid foot lateral blades (24 and 25) extending from the bar (21) in the part (12); a plurality of rear foot blades (26*a* and 26*b*) extending from the bar (21) in the part (13), wherein the blades (22 to 26*b*) are integral with the bar (21), the blades (22 to 25) are attached to a lower surface of the mid sole, and at least a portion of each of the blades (26*a* and 26*b*) is buried in the part (13).

4 Claims, 15 Drawing Sheets

U.S. PATENT DOCUMENTS

| | | | | |
|---|---|---|---|---|
| 6,647,645 | B2 * | 11/2003 | Kita | 36/28 |
| 6,665,958 | B2 * | 12/2003 | Goodwin | 36/29 |
| 6,931,764 | B2 * | 8/2005 | Swigart et al. | 36/29 |
| 7,441,346 | B2 * | 10/2008 | Hardy et al. | 36/25 R |
| 7,464,489 | B2 * | 12/2008 | Ho | 36/28 |
| 2002/0129516 | A1 | 9/2002 | Lucas et al. | |
| 2003/0061731 | A1 | 4/2003 | Turner et al. | |
| 2005/0011085 | A1 * | 1/2005 | Swigart et al. | 36/31 |
| 2005/0034328 | A1 * | 2/2005 | Geer | 36/30 R |

FOREIGN PATENT DOCUMENTS

| | | |
|---|---|---|
| JP | 2000-197503 | 7/2000 |
| JP | 2000-287709 | 10/2000 |
| JP | 2001-299404 | 10/2001 |
| JP | 2002-034605 | 5/2002 |
| JP | 2002-320502 | 11/2002 |
| WO | WO 2004/066771 | 8/2004 |

* cited by examiner

SHOE SOLE WITH REINFORCING STRUCTURE AND SHOE SOLE WITH SHOCK-ABSORBING STRUCTURE

TECHNICAL FIELD

The present invention relates to a shoe sole and, more particularly, to a reinforcing structure of a mid foot part and a shock-absorbing structure of a rear foot part.

BACKGROUND ART

Shoe soles having a reinforcing member conforming to the shape of the arch of the mid sole in an arch portion of the shoe soles, e.g., shoe soles in which a portion of the mid sole that is not attached to the outer sole does not touch the ground when the outer sole lands, are known in the art. Such a reinforcing member reinforces the rigidity of the arch portion of the mid sole by suppressing the deformation of the mid sole. The first to fourth patent documents, identified below, each disclose a known shoe sole structure with a reinforcing member, or the like.

[First Patent Document] Japanese Laid-Open Patent Publication No. 2000-287709 (Abstract)

[Second Patent Document] Japanese Laid-Open Patent Publication No. 63-194602 (FIG. 1, FIG. 2)

[Third Patent Document] Japanese Laid-Open Patent Publication No. 2001-299404 (Abstract)

[Fourth Patent Document] Japanese Laid-Open Patent Publication No. 2002-034605 (Abstract)

DISCLOSURE OF THE INVENTION

Japanese Laid-Open Patent Publication No. 2000-287709 discloses a shoe sole, in which a reinforcing member is provided so as to extend from the fore foot part to the rear foot part. The reinforcing member includes a rod-shaped portion elongated in the front-rear direction extending from the fore foot part to the rear foot part, and a blade that is rotatable about the axial line of the rod-shaped portion and that is provided rearward with respect to the arch portion.

However, in this shoe sole, the reinforcing member is provided in a depression (recess) on the upper surface of the sole. Such a reinforcing member will not be able to suppress the lowering of the foot arch.

Japanese Laid-Open Patent Publication No. 63-194602 discloses a shoe sole, in which a reinforcing member includes a reinforcing element extending in the longitudinal direction, with a blade being provided at the front end and at the rear end of the reinforcing element.

However, the reinforcing member is provided at the interface between the wearing sole and the mid sole, and the rear end portion thereof is not buried in the mid sole.

Japanese Laid-Open Patent Publication No. 2001-299404 discloses a shoe sole, in which the reinforcing member includes a strip-shaped longitudinal arch support piece along the central axis in the longitudinal direction of the outer sole, a strip-shaped first transverse arch support piece that extends across the longitudinal arch support piece and extends over an area from the first cuneiform bone of the foot to the distal end portion of the cuboid bone, and a second transverse arch support piece that extends over an area corresponding to the ball girth of the foot (from the ball to the antithenar).

The reinforcing member does not include a blade in the rear foot part.

Japanese Laid-Open Patent Publication No. 2002-034605 discloses a shoe sole, in which the reinforcing member includes, in addition to the structure of Japanese Laid-Open Patent Publication No. 2001-299404, a looped portion in the rear foot part.

However, the strip-shaped arch support piece forms a loop in an area rearward with respect to the front end of the heel portion.

Moreover, the looped arch support piece is provided in the rear foot part at the interface between the mid sole and the ground contact sole, and is not buried in the mid sole.

With such shoes, the rear foot part may be twisted excessively, or the arch may lower. It therefore will not be suitable for running or walking on an unleveled ground or a slope, as will be described below.

When running in a transverse direction on a slope during trail running, where one runs on an unleveled ground, the ankle is bent as shown in FIG. 14 with the high twist rigidity of ordinary running shoes. It is believed that this strains the ankle.

The bending of the ankle can be suppressed by making the mid sole more twistable. However, the mid sole will then be substantially twisted and deformed (lose shape), thus failing to stably support the foot.

Such a problem may occur, not only during trail running, but also on a sidewalk that is paved with a slant for drainage.

Therefore, the first object of the present invention is to provide a shoe sole with a reinforcing member capable of suppressing the lowering of the arch and the bending, wherein the mid sole is allowed to be twisted not only in the mid foot part but also in the rear foot part, while supporting the foot with the mid sole and the upper conforming to the foot.

A shoe sole is required, for example, to be light in weight, to have a holding function to hold the foot in a stable state, and to have a shock-absorbing function to absorb an impact of landing.

When one runs, a foot lands on the lateral side of the heel and then the foot falls toward the medial side. Thus, the lateral side of the heel receives a substantial impact upon landing. Therefore, if the lateral side of the rear foot part of the shoe sole deforms substantially, a high shock-absorbing function is fulfilled. In order to suppress the fall of the foot toward the medial side, the medial side of the rear foot part of the shoe sole can be made less deformable to thereby provide a high holding function. Thus, there are cases where the degree of deformation due to impact is preferably varied between the medial side and the lateral side of a foot.

The fifth to eighth patent documents, identified below, each discloses a shoe sole where the rear foot part is divided into separate portions.

[Fifth Patent Document] WO2004/066771A1 (Abstract)

[Sixth Patent Document] US2003/0061731A1 (Abstract)

[Seventh Patent Document] Japanese Laid-Open Patent Publication No. 2002-320502 (Abstract)

[Eighth Patent Document] U.S. Pat. No. 6,438,870B2 (FIG. 5)

WO2004/066771A1 and U.S. Pat. No. 6,438,870B2 each discloses a shoe sole, in which the rear foot part is divided in the medial-lateral direction.

US2003/0061731A1 and Japanese Laid-Open Patent Publication No. 2002-320502 each discloses a shoe sole, in which the shock-absorbing member is divided into separate portions in the rear foot part.

However, none of the fifth to eighth patent documents discloses the conception of making the rear foot part more twistable and making the deformation elements more individually deformable.

Thus, the second object of the present invention is to provide a shoe sole, in which the deformation element and the outer sole are each divided into separate portions in the rear foot part, wherein the rear foot part is made more twistable and the deformation elements are made more individually deformable.

The third object of the present invention is to provide a reinforcing structure of a sole capable of suppressing the lowering of the arch while allowing the sole to be twisted, wherein the bending of the shoe sole is prevented without detracting from the twisting of the mid foot part.

The fourth object of the present invention is to provide a novel structure for enhancing the shock-absorbing function and the repulsive function by means of a reinforcing member provided in the rear foot part of the mid sole.

The fifth object of the present invention is to provide a novel structure for attaching a rubber-like or pod-like compression deformation member to the sole.

In order to achieve the objects set forth above, the present invention provides a shoe sole with a novel reinforcing structure or a novel shock-absorbing structure.

One aspect of the present invention is directed to a shoe sole with a reinforcing structure, the shoe sole comprising a mid sole including a fore foot part, a mid foot part and a rear foot part, an outer sole attached to a lower surface of the mid sole, and a reinforcing member reinforcing a portion of the mid sole, wherein: the reinforcing member at least extends over an area from generally a front end of the mid foot part of the mid sole to generally a middle of the rear foot part in a front-rear direction, the reinforcing member including: a rod-shaped or strip-shaped main bar extending along a line that is generally at a center of a foot with respect to a medial-lateral direction from generally a center of the mid foot part in the front-rear direction to generally the middle of the rear foot part in the front-rear direction; a mid foot medial blade extending in the mid foot part from the main bar toward a medial side of the foot; a mid foot lateral blade extending in the mid foot part from the main bar toward a lateral side of the foot; and a plurality of rear foot blades extending in the rear foot part from the main bar toward at least one of a medial or lateral side of the foot, wherein: the blades are integral with the main bar; and the mid foot medial blade and the mid foot lateral blade are attached to a lower surface of the mid sole, and at least a portion of each rear foot blade is buried in the rear foot part of the mid sole.

According to this aspect, the rod-shaped or strip-shaped main bar suppresses the bending of the foot in the mid foot part or the lowering of the arch. Moreover, the plurality of blades and the main bar are arranged together like the ribs and the spine, thereby allowing the blades to be displaced so as to rotate about the main bar. Therefore, in the mid foot part and the rear foot part, the shoe sole is allowed to twist about the main bar. Therefore, when walking in a transverse direction on a slope, even if the fore foot part of a foot lands slanted, the shoe sole can twist accordingly, whereby the rear foot part of the foot can remain close to being horizontal. Therefore, it is possible to suppress the left-right bending of the leg at the ankle.

Moreover, the mid foot medial blade and the mid foot lateral blade, extending toward the medial side and the lateral side of the foot, can suppress the substantial twisting of the mid sole in the mid foot part to prevent the mid sole from losing its shape, and thus are effective in supporting the foot with the mid sole conforming to the foot in the mid foot part.

On the other hand, the rear foot blade is effective in supporting the foot with the mid sole conforming to the heel of the foot in the rear foot part.

Particularly, as compared with the mid foot blade attached to the lower surface of the mid sole, the rear foot blade buried in the mid sole contributes less to the increase in the twist rigidity, whereby it is more twistable and better supports the foot.

In the present invention, the mid sole is a portion of the shoe sole that has a shock-absorbing function and that does not essentially contact the ground. The material of the mid sole is not limited to any particular material, and the mid sole may be a foam such as an EVA (ethylene-vinylacetate copolymer) or a PU (polyurethane), a gel substance such as a polyurethane gel, a pod-like or bag-like member that is filled with the air, a gel substance, a rubber-like elastic member, or the like, or a composite material using these materials in combination.

In the present invention, the outer sole means the ground contact sole.

In this aspect, each blade may be in a strip shape or a thin plate shape, and it is preferred that the mid foot medial blade and the mid foot lateral blade are thinner than the main bar.

In this aspect, the shape of the reinforcing member in the mid foot part as viewed from above is not limited to any particular shape, but may be, for example, a star-like shape, a Y-letter shape, etc., as well as the H-letter shape.

In the present invention, the main bar may include two rod-shaped portions.

In the present invention, the mid foot medial blade extending "from the main bar toward the medial side of the foot" refers not only to a case where the mid foot medial blade extends from the main bar toward the medial side in the transverse direction (the width direction perpendicular to the longitudinal direction of the foot), but also to a case where the mid foot medial blade extends from the main bar toward the medial side in a frontward or rearward diagonal direction.

In the present invention, the mid foot lateral blade extending "from the main bar toward the lateral side of the foot" refers not only to a case where the mid foot lateral blade extends from the main bar toward the lateral side in the transverse direction (the width direction perpendicular to the longitudinal direction of the foot), but also to a case where the mid foot lateral blade extends from the main bar toward the lateral side in a frontward or rearward diagonal direction.

In the present invention, "a line that is generally at the center of the foot with respect to the medial-lateral direction" includes a line that generally bisects the bottom surface of the mid sole into a medial portion and a lateral portion, a line that runs between the middle of the rear foot part with respect to the front-rear direction and the medial-lateral direction and the metatarsal bone of the second toe or the third toe, and any straight or curved line near these two lines.

In this aspect, it is preferred that the mid sole includes an upper mid sole in which a mid foot part and a rear foot part are integrally formed, and a lower mid sole, wherein at least one of the rear foot blades is sandwiched between the upper mid sole and the lower mid sole in the rear foot part.

Then, the rear foot blade can easily be buried in the mid sole in the manufacturing process. The lower mid sole may be formed by an EVA foam, the gel substance, the pod-like or bag-like member, or a composite material thereof. The lower mid sole may be formed only by an EVA foam or only by a gel substance.

Where a part or whole of the upper and lower mid soles is formed by a resin foam, it is preferred that the hardness of the resin foam of the upper mid sole is greater than that of the resin foam of the lower mid sole.

Then, the hard upper mid sole increases the stability in supporting the foot, while the impact of landing is absorbed by the soft lower mid sole.

In this aspect, it is preferred that a plurality of the mid foot medial blades are provided in the mid foot part, being spaced apart from one another in the front-rear direction of the foot, and a plurality of the mid foot lateral blades are provided in the mid foot part, being spaced apart from one another in the front-rear direction of the foot.

Then, with the plurality of mid foot medial (lateral) blades being separated from each other in the front-rear direction, a plurality of mid foot blades can individually rotate about the main bar. Thus, the main bar is allowed to twist smoothly and gradually in the front-rear direction of the foot, as does the spine. Therefore, it is possible to realize an appropriate degree of twist of the shoe sole while preventing an excessive twist thereof.

In a preferred embodiment of this aspect, the rear foot blades include a rear foot medial blade extending from the main bar toward the medial side of the foot and a rear foot lateral blade extending toward the lateral side of the foot.

According to this embodiment, the foot is supported by the medial and lateral rear foot blades, whereby it is possible to suppress the sideway bending of the leg at the ankle and the instability of the foot in the medial-lateral direction.

In the present invention, the rear foot medial blade extending "from the main bar toward the medial side of the foot" refers not only to a case where the rear foot medial blade extends from the main bar toward the medial side in the transverse direction (the width direction perpendicular to the longitudinal direction of the foot), but also to a case where the rear foot medial blade extends from the main bar toward the medial side in a frontward or rearward diagonal direction.

In the present invention, the rear foot lateral blade extending "from the main bar toward the lateral side of the foot" refers not only to a case where the rear foot lateral blade extends from the main bar toward the lateral side in the transverse direction (the width direction perpendicular to the longitudinal direction of the foot), but also to a case where the rear foot lateral blade extends from the main bar toward the lateral side in a frontward or rearward diagonal direction.

In the present embodiment, it is preferred that the rear foot medial blade includes a medial roll-up portion that is curved along a medial side surface of the foot at a medial edge of the foot, and the rear foot lateral blade includes a lateral roll-up portion that is curved along a lateral side surface of the foot at a lateral edge of the foot.

These two roll-up portions support the rear foot part from the medial side and the lateral side via the mid sole, thus further improving the stability.

In this case, it is more preferred that the mid sole includes a mid sole body of a resin foam to which an upper surface of the rear foot blade is joined, and a rubber-like or pod-like compression deformation member located below the rear foot blade; and the compression deformation member is located between a corresponding one of the roll-up portions and the outer sole on at least one of the medial side and the lateral side of the foot.

The rubber-like or pod-like compression deformation member improves the shock-absorbing function of the rear foot part.

A "rubber-like or pod-like compression deformation member" is a member capable of accumulating a repulsive force while being deformed when it is compressed, and may include a member with rubber elasticity such as a thermoplastic elastomer or a vulcanized rubber, as well as a pod-like or bag-like member filled with the air, a gel substance, a soft rubber-like elastic member, or the like. Note that a thermoplastic elastomer is a polymer material that exhibits the property of a vulcanized rubber at room temperature but can be plasticized at high temperature so as to be molded by a plastic processing machine.

In the present embodiment, it is preferred that the rear foot medial blade and the rear foot lateral blade are connected to each other via a portion of the main bar, and the main bar and the rear foot blades are formed together generally along an upwardly-protruding curved line in the portion or a vicinity thereof.

Then, the rear foot blades arranged along an upwardly-protruding curved line serve as a curved beam when receiving a load from above, whereby the rear foot blades flexibly bend while maintaining a predetermined rigidity. This is effective in realizing light-weight blades.

Moreover, the upwardly-protruding curved beam is effective in absorbing the impact of landing and in preventing the twist.

The phrase "the main bar and the rear foot blades being formed together generally along an upwardly-protruding curved line in the portion or a vicinity thereof" refers to a shape in which the rear foot blade gradually rises toward the main bar in the portion or the vicinity thereof, and the cross section of the rear foot blade taken in the direction in which the rear foot blade extends may be an arch-shaped curve.

In this aspect, it is preferred that the outer sole is attached to a fore foot part and a rear foot part of the mid sole, and no outer sole is attached to a majority of a mid foot part of the mid sole, thereby forming an arch therein; and the mid foot medial blade and the mid foot part lateral blade are attached to a lower surface of the arch in the mid foot part of the mid sole.

Then, there is no hard outer sole over the majority of the mid foot part, and it is possible to improve the twistable property of the mid foot part.

In this aspect, it is preferred that the main bar extends along a line that is generally at the center of the foot with respect to the medial-lateral direction from generally a front end of the mid foot part to generally the middle of the rear foot part in the front-rear direction. Then, it is possible to improve the effect of the main bar in suppressing the lowering of the arch in the mid foot part or the bending.

Another aspect of the present invention is directed to a shoe sole having a shock-absorbing structure in a rear foot part, the shoe sole comprising: a support element capable of being compressively deformed by an impact upon landing to thereby absorb the impact, while supporting an entire area at least from a mid foot part to a rear foot part of the foot; a deformation element located below the support element in the rear foot part of the foot, wherein the deformation element is capable of being deformed into a vertically compressed position (state) upon landing; a connecting member inserted between the support element and the deformation element in the rear foot part for connecting the support element and the deformation element to each other; and an outer sole joined to a lower surface of the deformation element, wherein the outer sole contacts a road surface, wherein: the deformation element and the outer sole are each essentially divided into portions at least in a medial-lateral direction and/or a front-rear direction in the rear foot part of the foot, the portions being located in at least two island-shaped regions of the rear foot part of the foot; the connecting member at least extends over an area from generally a front end of the mid foot part of the support element to generally a middle of the rear foot part in the front-rear direction; the connecting member includes: a rod-shaped or strip-shaped main bar extending along a line that is generally at the center of the foot with respect to the medial-lateral direction from generally a front end of the rear foot part of the support element to generally the middle of the rear foot part in the front-rear direction; and a plurality of rear foot blades integral with the main bar; the plurality of rear foot blades are separated from one another and extend in the rear foot part from the main bar toward the island-shaped regions; and the essentially divided portions of the deformation element are provided so as to correspond to the rear foot blades.

Since the deformation element is essentially divided into portions in the rear foot part, the continuity of deformation between different regions of the rear foot part is broken. By interrupting the continuity of deformation, it is easier to design a shoe sole having different degrees of deformability for different regions, for example.

Since the main bar is arranged along a line that is generally at the center of the foot with respect to the medial-lateral direction, with the blades extending in different directions from the main bar, the separated blades allow the rear foot part to be twisted. Therefore, the continuity of deformation between the deformation elements is reduced, whereby the deformation elements are made more individually deformable.

The phrase "the deformation element and the outer sole being each essentially divided into portions in the rear foot part of the foot" means that the continuity of deformation between the deformation elements is substantially broken or very small between the island-shaped regions in the rear foot part of the foot, and includes a case where a plurality of deformation elements are formed separately and spaced apart from one another, and a case where a plurality of deformation elements are formed as an integral member via thin or narrow connecting portions.

For example, the deformation element may be formed by a foam such as an EVA or a PU, the gel substance, the pod-like or bag-like member, or a composite material thereof. The deformation element may be formed only by a foam such as an EVA whose hardness is less than or greater than that of the support element.

The connecting member does not need to be a single member, but may include two or more members.

In the present invention, the term "join (joined)" refers to a concept including both direct joint and indirect joint.

In this aspect, it is preferred that the main bar extends along the line in a rod-shaped or strip-shaped pattern to generally the front end of the mid foot part, thereby forming a reinforcing member capable of suppressing lowering of an arch in the mid foot part of the support element.

Then, it is possible to control the excessive twist of the mid foot part. Therefore, it is more twistable also between the discrete deformation elements in the rear foot part. Thus, the continuity of deformation between the deformation elements is reduced, thereby making the deformation elements more individually deformable.

In this aspect, it is preferred that a Young's modulus of a material of the connecting member is greater than that of a material of the support element.

Moreover, it is more preferred that the deformation element includes a rubber-like or pod-like compression deformation member, wherein a Young's modulus of the compression deformation member is less than that of the material of the support element.

In a preferred embodiment of this aspect, each deformation element is a small lump of material, and the support element is in a thin plate shape. If the lump-shaped deformation element is joined directly to the plate-shaped support element, the localized stress, etc., may weaken the joined portion between the support element and the deformation element or may cause an upthrusting feel on the foot sole. In view of this, the deformation element and the support element are joined to each other via a hard connecting member therebetween, whereby it is possible to improve the strength of the joined portion. Moreover, the impact imparted on the deformation element can be dispersed by the connecting member across the support element.

In one embodiment of this aspect, the connecting member includes a base portion located generally at a middle of the rear foot part, wherein the rear foot blades extend from the base portion. There may be three or more rear foot blades, and the rear foot blades may extend radially from the base portion. The rear foot blades extending radially from the base portion do not cause the continuity of deformation between the deformation elements, whereby such a structure is suitable for allowing the deformation elements to be deformed differently.

Another aspect of the present invention is directed to a shoe sole with a reinforcing structure, the shoe sole comprising a reinforcing member for reinforcing a mid foot part of a mid sole, the reinforcing member including: a rod-shaped or strip-shaped main bar extending along a line that is generally at a center of a foot with respect to a medial-lateral direction at least over an area from generally a front end of the mid foot part to generally a rear end of the mid foot part; a plurality of mid foot medial blades extending in the mid foot part from the main bar toward a medial side of the foot; and a plurality of mid foot lateral blades extending in the mid foot part from the main bar toward a lateral side of the foot, wherein: the blades are integral with the main bar; the mid foot medial blades are spaced apart from each other in a front-rear direction, and the mid foot lateral blades are spaced apart from each other in the front-rear direction; and a thickness of the main bar is greater than those of the mid foot medial blades and the mid foot lateral blades.

According to this aspect, the rod-shaped or strip-shaped main bar suppresses the bending of the foot in the mid foot part or the lowering of the arch. Moreover, the plurality of blades and the main bar are arranged together like the ribs and the spine, thereby allowing the blades to be twisted about the main bar.

Particularly, with the plurality of mid foot medial (lateral) blades being separated from each other in the front-rear direction, a plurality of mid foot blades can individually rotate about the main bar. Thus, the main bar is allowed to twist smoothly and gradually in the front-rear direction of the foot, as does the spine. Therefore, it is possible to realize an appropriate degree of twist of the shoe sole while preventing an excessive twist thereof.

The thickness of the main bar herein refers to the thickness of the thickest portion of the main bar, and the thickness of the blade herein refers to the thickness of the thickest portion of the blade.

In this aspect, the shape of the reinforcing member in the mid foot part as viewed from above is not limited to any particular shape, but may be, for example, a star-like shape, a Y-letter shape, etc., as well as the H-letter shape.

In one embodiment of this aspect, the main bar includes a rod-shaped portion having a greater thickness than that of the mid foot medial blade and the mid foot lateral blade, wherein the rod-shaped portion extends in the front-rear direction of the foot from a front end of the mid foot part in the front-rear direction to a rear end of the mid foot part in the front-rear direction.

Then, the rod-shaped portion does not detract from the twistable property but it is less bendable, whereby it can further improve the function to suppress the lowering of the arch while allowing for the twist of the shoe sole.

The thickness of the rod-shaped portion herein refers to the thickness of the ridge portion of the rod-shaped portion (the thickest portion thereof in the cross section including the ridgeline).

In one embodiment of this aspect, the main bar includes a rod-shaped portion having a rod shape, a medial strip-shaped portion having a strip shape that is connected to a medial side of the rod-shaped portion, and a lateral strip-shaped portion having a strip shape that is connected to a lateral side of the rod-shaped portion, with the strip-shaped portions being integral with the rod-shaped portion; the mid foot medial blades extend from the medial strip-shaped portion toward the medial side of the foot; and the mid foot lateral blades extend from the lateral strip-shaped portion toward the lateral side of the foot.

Then, with the provision (position) of the strip-shaped portion on the medial side and the lateral side of the thick rod-shaped portion, it is possible to suppress the stress concentration when the blades are deformed.

With only the rod-shaped portion, the reaction against the lowering of the arch will be local, whereas with the provision of the medial and lateral strip-shaped portions, there will be stable reaction against the lowering of the arch and against the planar bending of the sole.

With the strip-shaped portions having larger bonding surfaces than the rod-shaped portion, the reliability of the bonding between the main bar and the mid sole is improved.

Another aspect of the present invention is directed to a shoe sole having a shock absorber in a rear foot part, the shoe sole including a mid sole including a rear foot part, and a reinforcing member for reinforcing the rear foot part of the mid sole, wherein: the reinforcing member includes a base portion that is located generally at a middle of the rear foot part with respect to a front-rear direction and a medial-lateral direction, and at least three blades extending in different directions from the base portion, wherein the blades are integral with the base portion; the mid sole is located directly above the blades and the base portion; separate portions of an outer sole are located directly below the blades, with no outer sole being located directly below the base portion; and in a vicinity of the base portion, each blade gradually bulges upward toward the base portion.

According to this aspect, an arch is formed by the bulging of the blades, and the shock-absorbing function and the repulsive function of the rear foot part are improved by the bending of the arch.

Particularly, with the separated blades, as opposed to a single plate, the degree of bending of the arch is large. Therefore, it is possible to enhance the shock-absorbing function and the repulsive function.

The phrase "in a vicinity of the base portion, each blade gradually bulging upward toward the base portion" means that at the base portion or in the vicinity thereof, the cross section (in the cross-sectional line across the two blades) of the two blades and the base portion forms a protruding portion that is protruding upward, and the shape of the cross section includes a generally arch-like shape.

In one embodiment of this aspect, the mid sole includes a support element capable of being compressively deformed by an impact upon landing to thereby absorb the impact, while supporting an entire area extending at least from a mid foot part to a rear foot part of a foot, and a deformation element located below the support element in the rear foot part of the foot, wherein the deformation element is capable of being deformed into a vertically compressed position (state) upon landing; and the reinforcing member forms a connecting member inserted between the support element and the deformation element in the rear foot part for connecting the support element and the deformation element to each other.

Then, it is preferred that a Young's modulus of a material of the reinforcing member is greater than that of a material of the support element.

Then, it is possible to form the arch by a hard material, and to better exert the shock-absorbing function and the repulsive function. The deformation element and the support element are joined to each other via a hard connecting member therebetween, whereby it is possible to improve the strength of the joined portion. Moreover, the impact imparted on the deformation element can be dispersed by the connecting member across the support element.

In one embodiment, the deformation element includes a rubber-like or pod-like compression deformation member, wherein a Young's modulus of the compression deformation member is less than that of the material of the support element.

In this aspect, it is preferred that each blade has an edge extending to a side surface and/or a back surface of the mid sole in the rear foot part; and the edge forms a roll-up portion that is rolled upward.

These two roll-up portions support the rear foot part from the medial side and the lateral side via the mid sole, thus improving the stability.

In one embodiment, a mid sole body of a resin foam is located directly above the roll-up portion, and a rubber-like or pod-like compression deformation member is located directly below the roll-up portion; and a Young's modulus of the compression deformation member is less than that of a material of the mid sole body.

Since there is a larger space below the roll-up portion as compared with a case where the roll-up portion is not provided, it is easier to place the compression deformation member on the edge. Thus, it is possible to further enhance the shock-absorbing function and the repulsive function.

Another aspect of the present invention is directed to a shoe sole, comprising a mid sole covering a foot sole, and an outer sole attached to a lower surface of the mid sole, wherein the outer sole contacts a ground; the mid sole includes a mid sole body of a resin foam, and a rubber-like or pod-like compression deformation member that is externally exposed on a side surface or a back surface of the mid sole; a holding member is provided for holding the compression deformation member at a predetermined position in cooperation with the mid sole body or the outer sole; the holding member includes an joined portion secured to an upper surface or a lower surface of the compression deformation member, and a first engagement portion extending on the side surface or the back surface of the mid sole from the joined portion in an upward direction or a downward direction; and the first engagement portion engages with the compression deformation member to thereby prevent the compression deformation member from popping out.

According to this aspect, the compression deformation member is more stably fixed in cases where the member is located so as to be exposed on the side surface or the back surface of the sole in order to reduce the impact upon first strike or enhance the repulsive function, or for aesthetic reasons. Even if the wearer, etc., attempt to pull out the compression deformation member out of curiosity, it will not easily be done.

In a preferred embodiment of this aspect, the mid sole body includes a recessed portion whose height in a vertical direction gradually increases from a center of a fore foot part of the mid sole with respect to a front-rear direction and a medial-lateral direction or a middle of the rear foot part with respect to the front-rear direction and the medial-lateral direction toward the side surface or the back surface; the compression deformation member is located in the recessed portion; and the joined portion of the holding member is secured to a lower surface of the recessed portion of the mid sole body, and the first engagement portion extends downward from the joined portion to engage with an upper portion of an edge of the compression deformation member.

Then, with the provision of the recessed portion into which the compression deformation member is fitted, it is possible to stably hold the compression deformation member, a large area of which is externally exposed. The recessed portion may extend across generally the same area as the joined portion of the holding member.

In one embodiment of this aspect, the mid sole body includes an upper mid sole body including the recessed portion, and a lower mid sole body located below the upper mid sole body; the compression deformation member is sandwiched between the holding member and the lower mid sole body; the lower mid sole body includes a second engagement portion that is rolled upward at an edge of the recessed portion on the side surface or the back surface; and the second engagement portion engages with the compression deformation member to thereby prevent the compression deformation member from popping out.

In one embodiment, the outer sole includes a third engagement portion that is rolled upward at an edge of the recessed portion on the side surface or the back surface; and the third engagement portion directly or indirectly engages with the compression deformation member to thereby prevent the compression deformation member from popping out.

Thus, with the provision of the second or third engagement portion, not only the upper portion but also the lower portion of the compression deformation member engage with the mid sole body or the outer sole, whereby it is possible to stably hold the compression deformation member.

In order to stably hold the compression deformation member, a shape of the first engagement portion as viewed from the side surface or the back surface may be an upwardly-protruding arch shape in the present embodiment.

Then, the rigidity of the first engagement portion is increased, whereby it is possible to stably hold the compression deformation member.

In this aspect, it is preferred that a Young's modulus of a material of the holding member is greater than that of a material of the mid sole body; and a cross-sectional shape of the joined portion of the holding member in a sectional line along the side surface or the back surface is an upwardly-protruding arch shape.

With such a structure, where the joined portion of the holding member is formed in an arch shape, the bending rigidity of the holding member having a large Young's modulus is increased. Therefore, it is possible to enhance the shock-absorbing function or the repulsive function at the edge of the side surface or the back surface.

BRIEF DESCRIPTION OF THE DRAWINGS

FIGS. 11A and 11B each illustrates a second embodiment, wherein FIG. 11A is a cross-sectional view taken along line XIA-XIA in FIG. 13, and FIG. 11B is a cross-sectional view taken along line XIB-XIB in FIG. 13.

FIGS. 15A and 15B each illustrates a third embodiment, wherein FIG. 15A is a cross-sectional view taken along line XVA-XVA in FIG. 15B, and FIG. 15B is a bottom view of a reinforcing member.

DESCRIPTION OF THE REFERENCE NUMERALS

Figure 1A:
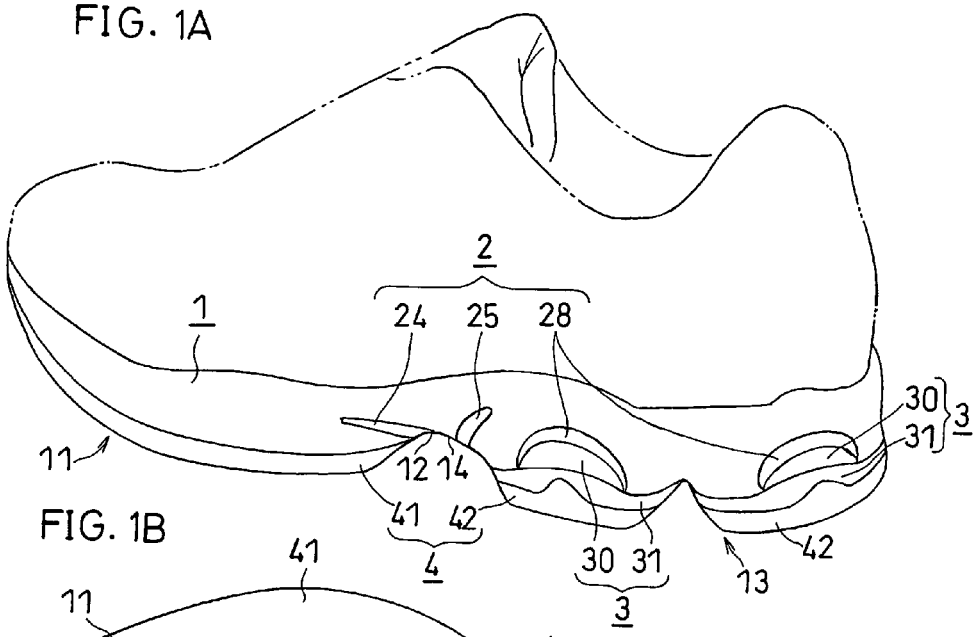
FIG. 1A is a perspective view of a shoe sole of a first embodiment, as viewed from the upper side.

11: Fore foot part
12: Mid foot part
13: Rear foot part
1: Upper mid sole
14: Arch
15: Recessed portion
2: Reinforcing member (connecting member, holding member)
21: Main bar
21*a*: Medial rod-shaped portion
21*b*: Lateral rod-shaped member
21*c*: Base portion
21*d*: Rod-shaped portion
22, 23: Mid foot medial blades
24, 25: Mid foot lateral blades
26*a*: Rear foot medial blade
26*b*: Rear foot lateral blade
27: Joined portion
28: Roll-up portion
28*a*: Medial roll-up portion
28*b*: Lateral roll-up portion
28*c*: First engagement portion
28*d*: Engagement hole

3: Lower mid sole
30: Compression deformation member
30*a*: Edge
31: Shock-absorbing member
32: Second engagement portion
33: Third engagement portion
4: Outer sole
41: Front outer sole
42: Rear outer sole
F3: Third toe
C3: Metatarsal bone
C6: Cuboid bone
C7: Calcaneal bone
C8: Ankle bone
J3: Lisfranc joint
L: Front-rear direction
W: Medial-lateral direction
R1 to R4: Island-shaped regions
G: Groove

BEST MODE FOR CARRYING OUT THE INVENTION

The present invention will be understood more clearly from the following description of preferred embodiments taken in conjunction with the accompanying drawings. Note however that the embodiments and the drawings are merely illustrative, and the scope of the present invention shall be defined by the appended claims. In the accompanying drawings, like reference numerals denote like components throughout the plurality of figures.

First Embodiment

FIG. 1A to FIG. 7D each illustrates a first embodiment. In this and subsequent figures, "IN" and "OUT" denote the medial side and the lateral side of the foot, respectively. These figures show the structures while omitting design bumps/grooves. Such design bumps/grooves may be added as needed.

The following description is directed to a shoe sole for the left foot.

Figure 1B:
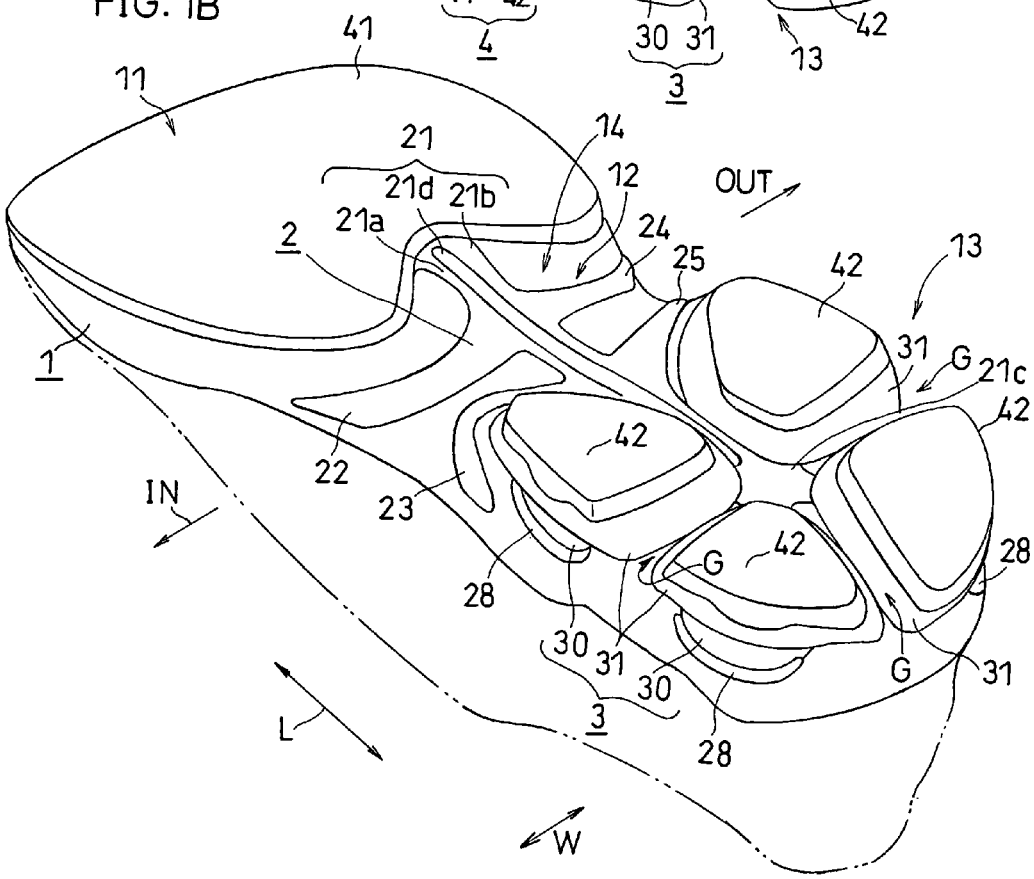
FIG. 1B is a perspective view of the shoe sole, as viewed from the bottom side.

General Configuration:

As shown in FIGS. 1A and 1B, a shoe sole of the present embodiment includes an upper mid sole 1, a reinforcing member 2, a lower mid sole 3 and an outer sole 4. In FIGS. 1A and 1B, a two-dot chain line represents the upper. The upper mid sole 1 and the lower mid sole 3 together form a mid sole. In a rear foot part 13, the lower mid sole 3 is divided into four portions.

Figure 2A:
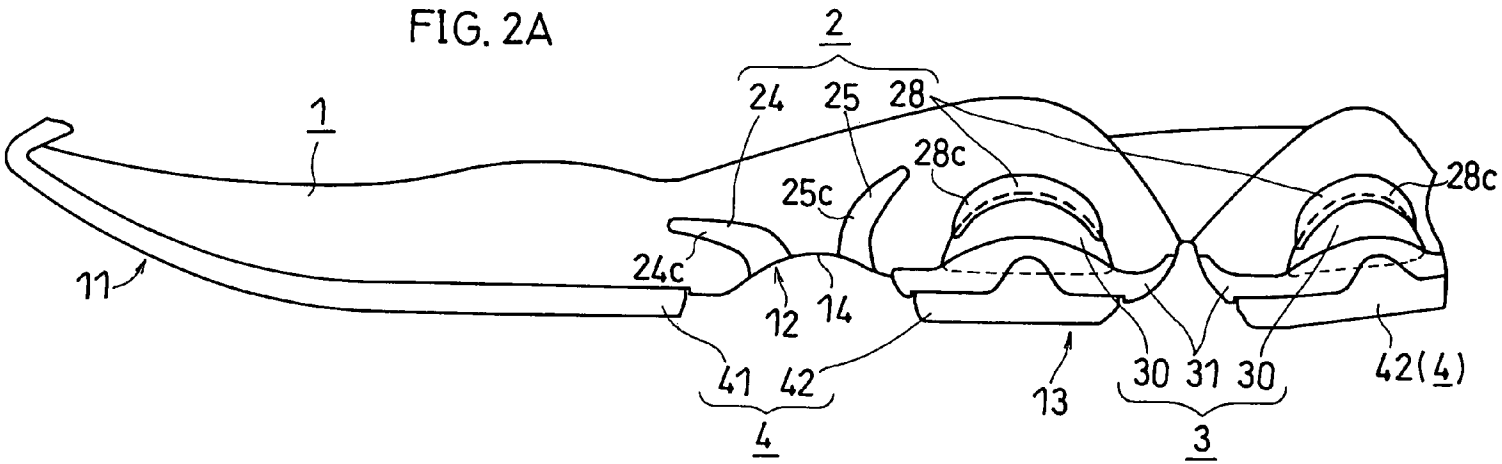
FIG. 2A is a lateral side view of the shoe sole.
Figure 2B:
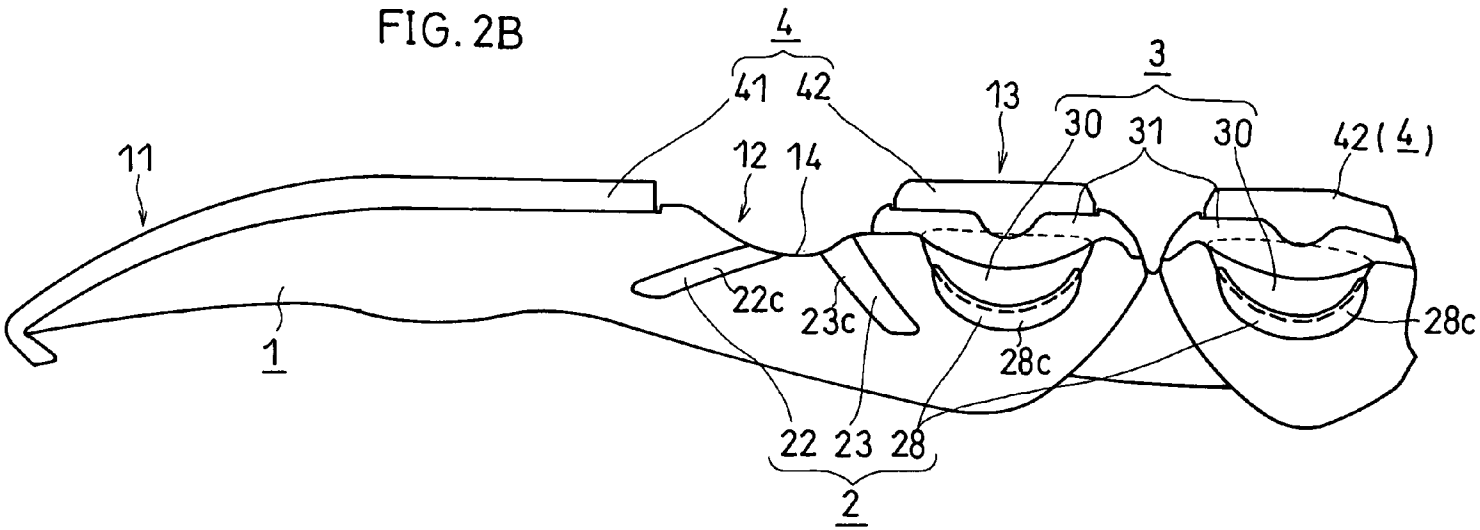
FIG. 2B is a medial side view of the shoe sole.

As shown in FIGS. 2A and 2B, the mid sole includes a fore foot part 11, a mid foot part 12 and the rear foot part 13.

The outer sole 4 is divided into a front outer sole 41 and a rear outer sole 42. The front outer sole 41 is attached to the lower surface of the upper mid sole 1 in the fore foot part 11. The rear outer sole 42 in the rear foot part 13 is divided into four portions corresponding to the four portions of the lower mid sole 3, each portion being attached to the lower surface of the corresponding portion of the lower mid sole 3. The outer sole 4 is not provided in the mid foot part 12.

Figure 3:
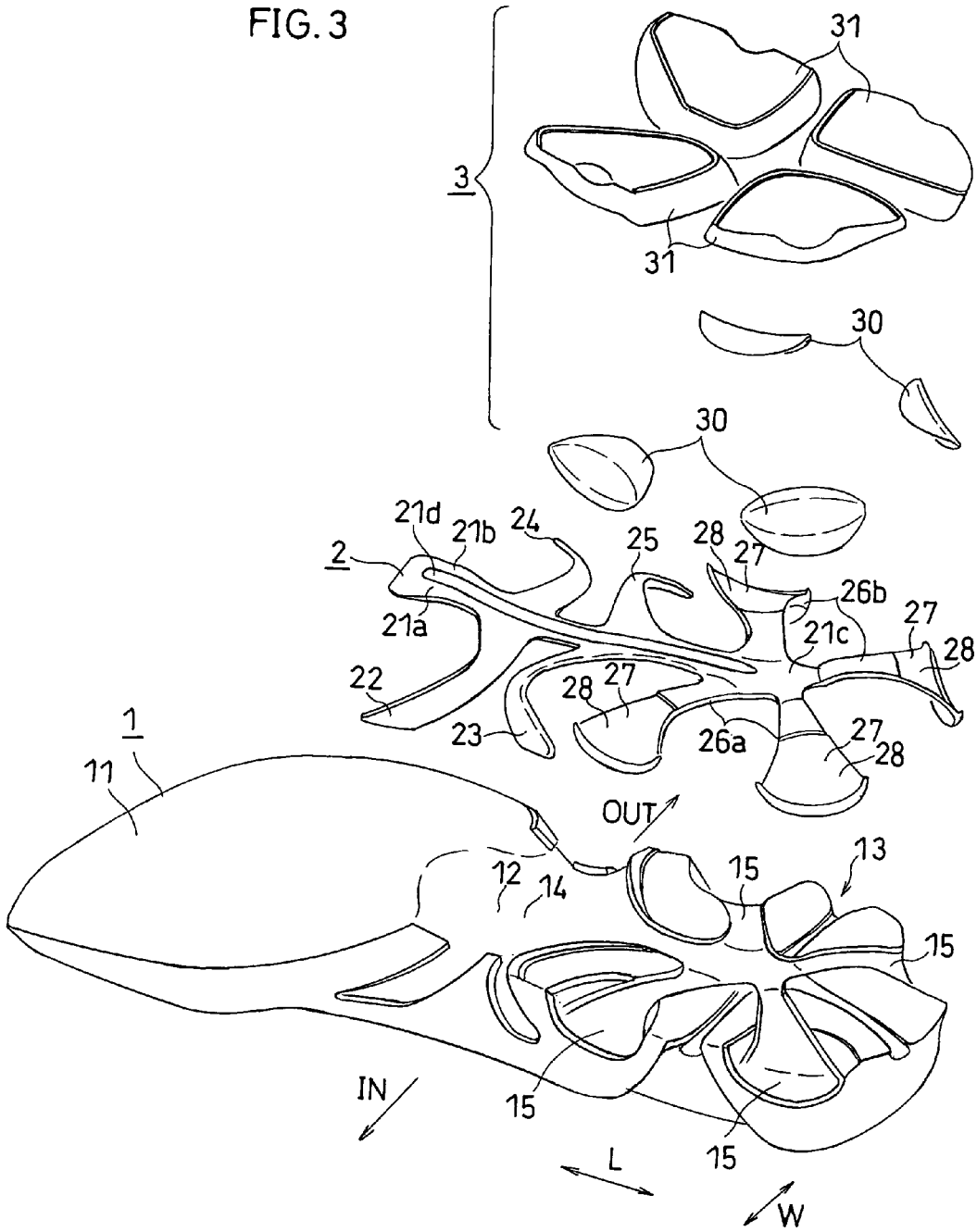
FIG. 3 is an exploded perspective view of shoe sole parts, as viewed from the bottom side of the shoe sole.
Figure 4:
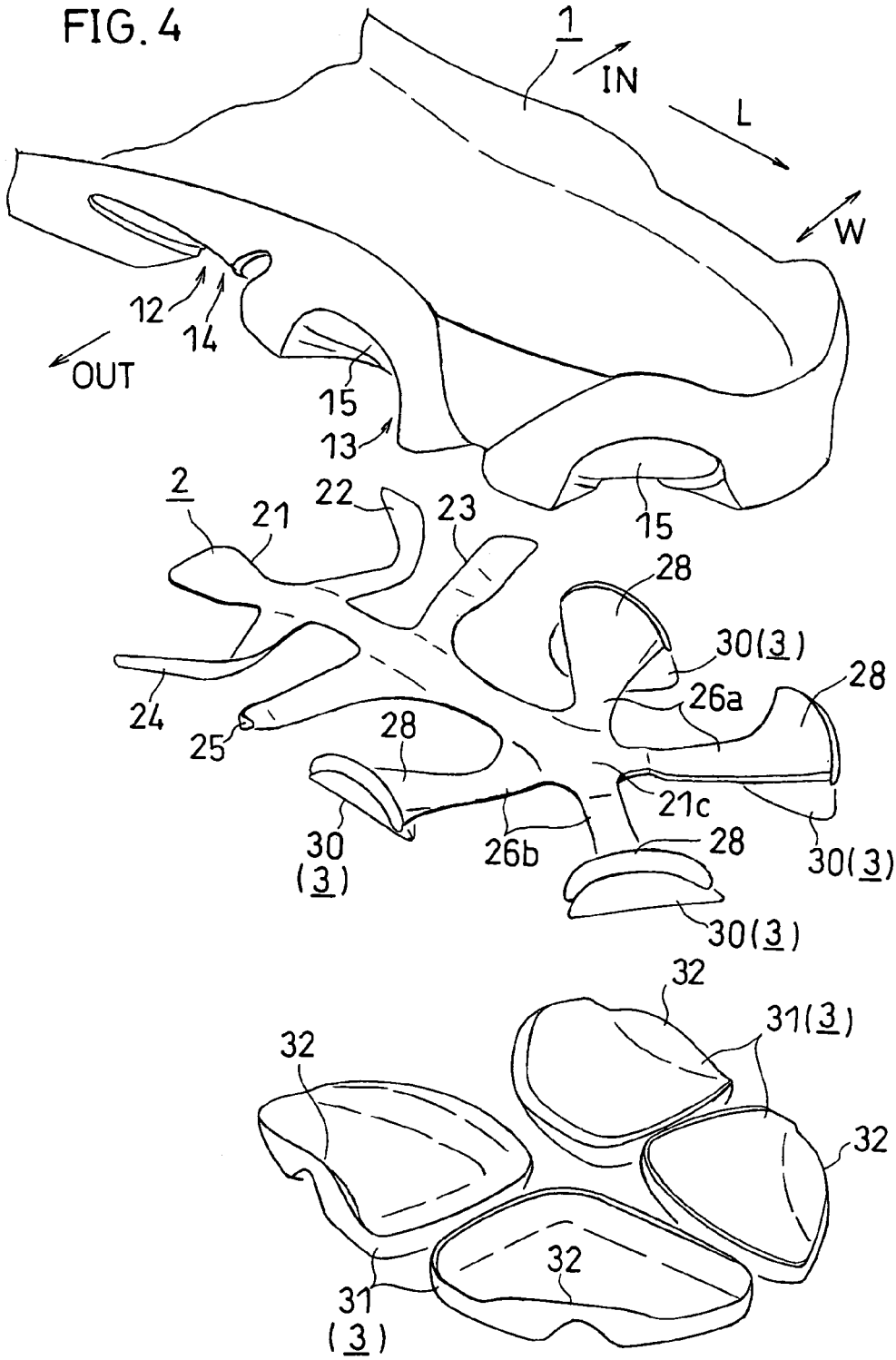
FIG. 4 is an exploded perspective view of shoe sole parts, as viewed from the upper side of the shoe sole.

As shown in FIG. 1B, the reinforcing member 2 is provided on the lower surface of the upper mid sole 1 in the mid foot part 12 and the rear foot part 13. As shown in FIGS. 3 and 4, the four portions of the lower mid sole 3 are attached to the lower surface of the reinforcing member 2 in the rear foot part 13, with each portion of the rear outer sole 42 being attached to the lower surface of the corresponding portion of the lower mid sole 3 (FIG. 1B).

Figure 5:
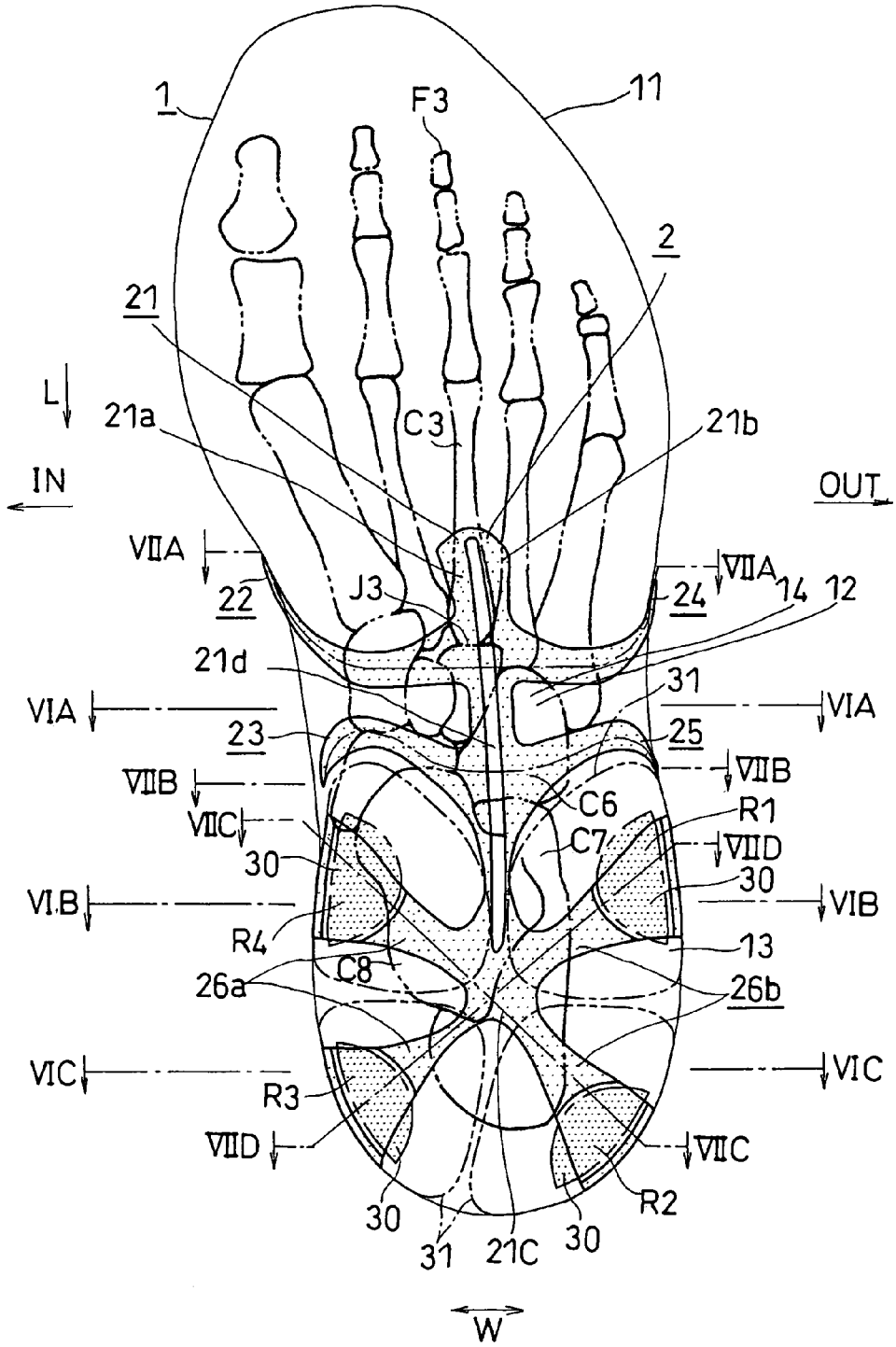
FIG. 5 is a bottom view of the shoe sole, showing the relationship between the shoe sole and foot bones.

Reinforcing Member 2:

As shown in FIG. 5, the reinforcing member 2 extends from generally the front end of the mid foot part 12 of the upper mid sole 1 in the front-rear direction L to the rear foot part 13. The reinforcing member 2 is an integral member including a main bar 21, mid foot medial blades 22 and 23, mid foot lateral blades 24 and 25, rear foot medial blades 26*a* and rear foot lateral blades 26*b*. The reinforcing member 2 is for reinforcing a portion of the mid sole, and the Young's modulus of the reinforcing member 2 is therefore greater than that of the mid sole. The material of the reinforcing member 2 may be, for example, a non-foamed resin such as a nylon, a polyurethane or an FRP.

In FIG. 5, a portion of the reinforcing member 2 excluding a rod-shaped portion 21*d* of the main bar 21 is sparsely dotted, and compression deformation members 30 to be described later are densely dotted, for a better understanding of the figure.

The main bar 21 is provided in a strip shape extending along a line that is generally at the center of the foot with respect to the medial-lateral direction from generally the front end of the mid foot part 12 in the front-rear direction L to generally the middle of the rear foot part 13 in the front-rear direction L. The position of the front end of the main bar 21 is generally at the center of the metatarsal bone C3 of the third toe F3 (the shaft of the third metatarsal bone), which is represented by a two-dot chain line.

The mid foot medial blades 22 and 23 extend, in the mid foot part 12, from the main bar 21 toward the medial side of the foot, whereas the mid foot lateral blades 24 and 25 extend, in the mid foot part 12, from the main bar 21 toward the lateral side of the foot. The front-side mid foot blades 22 and 24 extend from a position along (in) the main bar 21 that corresponds to the Lisfranc joint J3 of the third toe F3 or the vicinity thereof. The rear-side mid foot blades 23 and 25 extend from a position along (in) the main bar 21 that corresponds to the cuboid bone C6 or the vicinity thereof.

As shown in FIG. 1B, the mid foot medial blades 22 and 23 and the mid foot lateral blades 24 and 25 are adhered to the lower surface of the upper mid sole 1. Portions of the rear foot blades 26*a* and 26*b* are sandwiched between the upper and lower mid soles 1 and 3.

As shown in FIG. 5, the four rear foot blades 26*a* and 26*b* extend, in the rear foot part 13, from a base portion 21*c* of the main bar 21 at the rear end of the main bar 21 toward the medial side or the lateral side of the foot. In other words, the rear foot blades 26*a* and 26*b* extend radially from the base portion 21*c*.

The base portion 21*c* is located at a position corresponding to the calcaneal bone C7 or the ankle bone C8.

Mid Sole:

The upper mid sole 1 shown in FIG. 3 is made of a resin foam, for example, and forms a mid sole body being an integral member including the fore foot part 11, the mid foot part 12 and the rear foot part 13.

On the other hand, the four lower mid soles 3 are provided, in the rear foot part 13, being separated in the medial-lateral direction W and in the front-rear direction L. The lower mid soles 3 are provided, corresponding respectively to the rear foot blades 26*a* and 26*b*, so as to sandwich the rear foot blades 26*a* and 26*b* of the reinforcing member 2 between the lower mid soles 3 and the upper mid sole 1. Each lower mid sole 3 includes the rubber-like compression deformation member 30 and a resin-foam shock-absorbing member 31.

The upper mid sole (the upper mid sole body) 1 and the shock-absorbing member (the lower mid sole body) 31 are joined together in areas where the reinforcing member 2 is absent, thereby together forming the mid sole body.

As shown in FIG. 4, the compression deformation members 30 are joined to the lower surface of the rear foot blades 26*a* and 26*b*. A shock-absorbing member 31 is provided for each compression deformation member 30, and is joined to the lower surface of the compression deformation member 30. The hardness of the resin foam of the upper mid sole 1 is greater than that of the resin foam of the shock-absorbing members 31 of the lower mid sole 3. The Young's modulus of the compression deformation members 30 is less than those of the material of the upper mid sole 1 and the material of the shock-absorbing members 31.

Figure 6A:
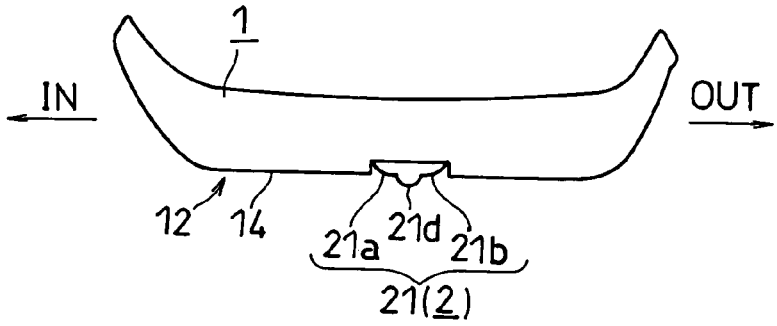
FIG. 6A is a cross-sectional view taken along line VIA-VIA in FIG. 5.
Figure 6B:
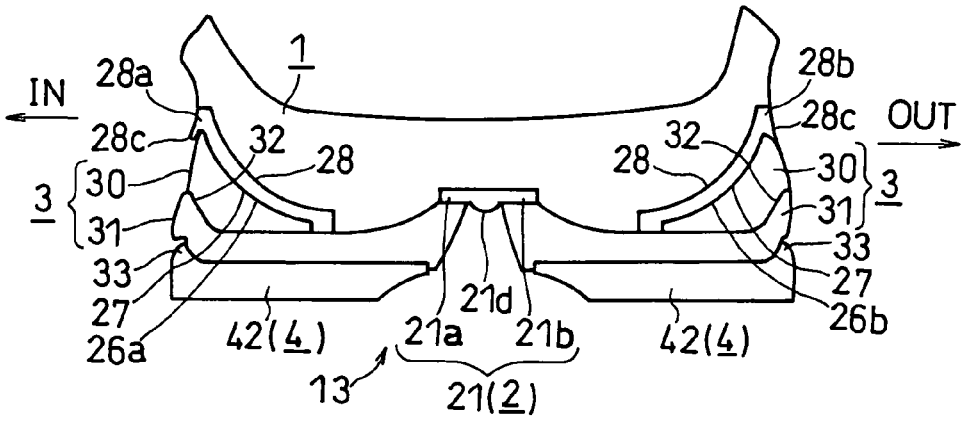
FIG. 6B is a cross-sectional view taken along line VIB-VIB in FIG. 5.
Figure 6C:
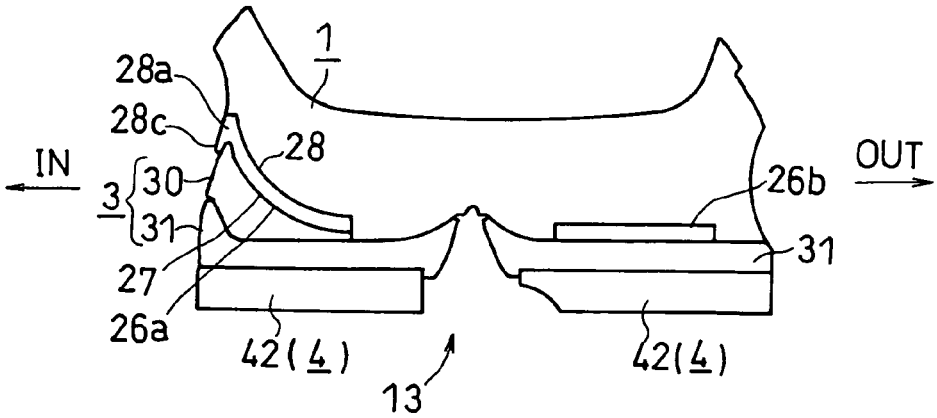
FIG. 6C is a cross-sectional view taken along line VIC-VIC in FIG. 5.

Outer Sole 4:

As shown in FIG. 1B, the front outer sole 41 is attached to the lower surface of the upper mid sole 1 in the fore foot part 11. As shown in FIGS. 6B and 6C, the rear outer soles 42 are adhered to the lower surface of the shock-absorbing members 31. As are the lower mid soles 3, the rear outer soles 42 are separated and spaced apart from one another in the medial-lateral direction W and in the front-rear direction L (FIG. 1B). As shown in FIGS. 2A and 2B, there is an arch 14 on the lower surface of the upper mid sole 1 in the mid foot part 12, to which the lower mid sole 3 and the outer sole 4 are not attached.

As shown in FIG. 5, the four lower mid soles 3 and the four outer soles 4 are located respectively in the four island-shaped regions R1 to R4, which are separated at least in the medial-lateral direction W and in the front-rear direction L in the rear foot part 13. The rear foot blades 26*a* and 26*b* extend radially from the base portion 21*c* into the regions R1 to R4. The reinforcing member 2, the lower mid sole 3 and the outer sole 4 are absent between the regions R1 and R2, between the regions R2 and R3 and between the regions R3 and R4. In these areas, grooves G that separate the regions R1 to R4 from one another extend radially from the base portion 21*c* between the lower mid soles 3, as shown in FIG. 1B.

Next, the structure of each portion of the shoe sole of the present embodiment will be described in detail.

Structure of Mid Foot Part 12:

As shown in FIG. 5, the main bar 21, the mid foot medial blades 22 and 23 and the mid foot lateral blades 24 and 25 of the reinforcing member 2 are adhered to the lower surface and the side surface of the arch 14 of the mid sole.

Main Bar 21:

The main bar 21 shown in FIG. 3 is an integral member including the rod-shaped portion 21*d*, a medial strip-shaped portion 21*a* having a strip shape on the medial side of the rod-shaped portion 21*d*, and a lateral strip-shaped portion 21*b* having a strip shape on the lateral side of the rod-shaped portion 21*d*.

Figure 7A:
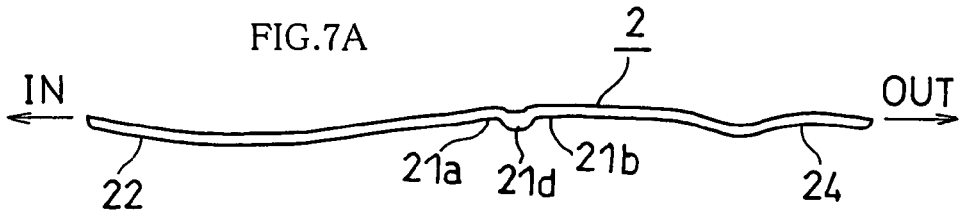
FIG. 7A is a cross-sectional view taken along line VIIA-VIIA in FIG. 5.
Figure 7B:
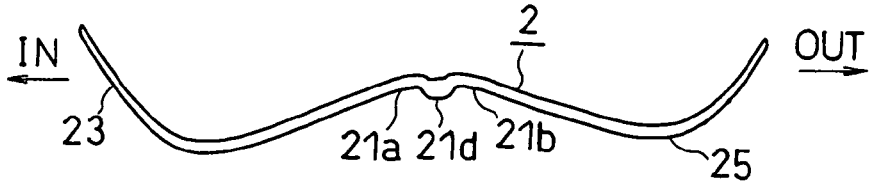
FIG. 7B is a cross-sectional view taken along line VIIB-VIIB in FIG. 5.

As shown in FIG. 5, the rod-shaped portion 21*d* of the main bar 21 extends in the front-rear direction L of the foot from the front end of the mid foot part 12 to generally the middle of the rear foot part 13. As shown in FIGS. 6A and 6B, the rod-shaped portion 21*d* protrudes downward with respect to the medial strip-shaped portion 21*a* and the lateral strip-shaped portion 21*b*. Therefore, as shown in FIGS. 7A and 7B, the thickness of the rod-shaped portion 21*d* in the main bar 21 is greater than those of the mid foot medial blades 22 and 23, the mid foot lateral blades 24 and 25, the medial strip-shaped portion 21*a* and the lateral strip-shaped portion 21*b*, to which the mid foot blades 22 to 25 are connected. Note that FIG. 7A is a cross-sectional view with the front-side mid foot blades 22 and 24 being slightly bent so that the blades are generally flat, and the roll-up of the edges to be described later is not clearly shown.

Mid Foot Blades 22 to 25:

As shown in FIGS. 1B, 2A and 2B, the mid foot blades 22 to 25 extend from the bottom surface of the mid foot part 12 of the upper mid sole 1 to the side surface thereof. The mid foot blades 22 to 25 covers a part of the bottom surface of the upper mid sole 1 and a part of the side surface thereof. The edges of the mid foot blades 22 to 25 are rolled up onto the medial side surface or the lateral side surface, thus forming roll-up portions 22*c* to 25*c*.

As shown in FIG. 5, the mid foot medial blades 22 and 23 extend from the medial strip-shaped portion 21*a* toward the medial side of the foot, and the mid foot lateral blades 24 and 25 extend from the lateral strip-shaped portion 21*b* toward the lateral side of the foot. The two mid foot medial blades 22 and 23, in the mid foot part 12, are spaced apart from each other in the front-rear direction L of the foot. The two mid foot lateral blades 24 and 25, in the mid foot part 12, are spaced apart from each other in the front-rear direction L of the foot.

As shown in FIGS. 2A and 2B, the mid foot medial blade 22 and the mid foot lateral blade 24 on the front side are curved along the side surface of the upper mid sole 1 while being bent in the frontward direction. On the other hand, the mid foot medial blade 23 and the mid foot lateral blade 25 on the rear side are curved along the side surface of the mid sole while being bent in the rearward direction. Thus, the roll-up portions 22*c* to 25*c* are rolled up along the side surface of the foot while being bent in the frontward direction or in the rearward direction.

Structure of Rear Foot Part 13:

The base portion 21*c* is formed at the rear end of the main bar 21 shown in FIG. 5. The base portion 21*c* is located generally at the middle of the rear foot part 13. The rear foot medial blades 26*a* and the rear foot lateral blades 26*b* extend radially about the base portion 21*c*. The four rear foot blades 26*a* and 26*b* and the base portion 21*c* are formed in a generally X-shaped pattern as viewed from above, with the base portion 21*c* being the center of the pattern.

As shown in FIG. 4, the upper mid sole 1 is located directly above the rear foot blades 26*a* and 26*b* and the base portion 21*c*. A lower mid sole 3 (30, 31) is provided separately for each of the rear foot blades 26*a* and 26*b* of the reinforcing member 2.

Therefore, as shown in FIG. 1B and FIG. 3, the separated lower mid soles 3 and the separated outer soles 4 are located together directly below the rear foot blades 26*a* and 26*b*.

As shown in FIG. 1B, the lower mid soles 3 and the outer soles 4, in the rear foot part 13, are essentially separated from one another in the medial-lateral direction W and in the front-rear direction L, and are located in the four island-shaped regions R1 to R4 (FIG. 5) of the rear foot part 13. Thus, the lower mid soles 3 and the outer soles 4 form four island-shaped units in the regions R1 to R4. On the other hand, the lower mid soles 3 and the outer soles 4 are absent directly below the base portion 21*c*.

Rear Foot Blades 26*a* and 26*b*:

As shown in FIG. 5, the rear foot blades include the two rear foot medial blades 26*a* extending from the base portion 21*c* toward the medial side of the foot, and the two rear foot lateral blades 26*b* extending toward the lateral side of the foot.

Figure 7C:
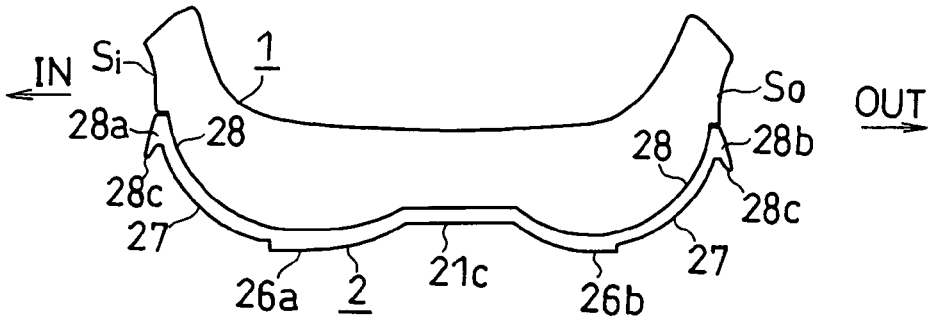
FIG. 7C is a cross-sectional view taken along line VIIC-VIIC in FIG. 5.
Figure 7D:
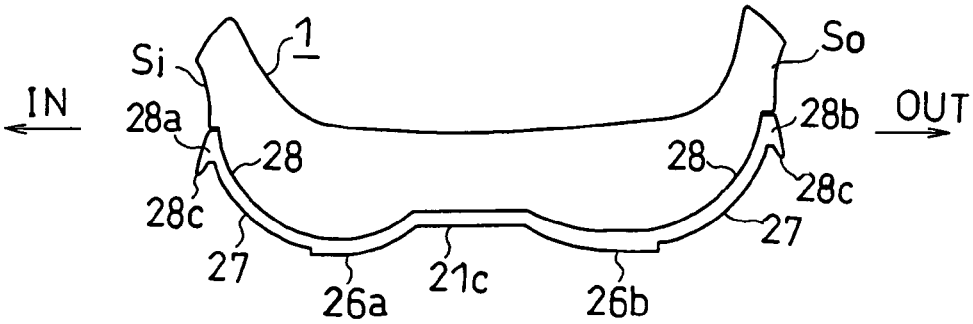
FIG. 7D is a cross-sectional view taken along line VIID-VIID in FIG. 5.

As shown in FIGS. 7C and 7D, the rear foot blades 26*a* and 26*b* extend to the side surface or the back surface (the peripheral surface) of the upper mid sole 1 in the rear foot part 13. The rear foot blades 26*a* and 26*b* are rolled up on the side surface or the back surface, thus forming roll-up portions 28.

As shown in FIGS. 7C and 7D, the rear foot medial blade 26*a* includes a medial roll-up portion 28*a* that is curved along the medial surface Si of the upper mid sole 1 at the medial edge of the foot. The rear foot lateral blade 26*b* includes a lateral roll-up portion 28*b* that is curved along the lateral surface So of the upper mid sole 1 at the lateral edge of the foot.

As shown in FIG. 4, the upper mid sole 1 is located directly above the roll-up portions 28. The rubber-like compression deformation members 30 are located directly below the roll-up portions 28.

As shown in FIGS. 7C and 7D, the rear foot medial blade 26*a* and the rear foot lateral blade 26*b* are connected to each other via the base portion 21*c* of the main bar 21 (FIG. 5), wherein these elements are arranged along an upwardly-protruding curved line at the base portion 21*c*. Therefore, in the vicinity of the base portion 21*c*, the rear foot blades 26*a* and 26*b* are bulging upward gradually toward the base portion 21*c*.

Support Element, Deformation Element, Connecting Member:

As shown in FIGS. 1A and 1B, the mid foot part 12 and the rear foot part 13 of the upper mid sole 1 form a support element capable of being compressively deformed by an impact upon landing to thereby absorb the impact, while supporting an area of the foot from the mid foot part 12 to the rear foot part 13.

The lower mid sole 3 is located below the upper mid sole 1 in the rear foot part 13 of the foot, forming a deformation element capable of being deformed into a vertically compressed position (state) upon landing.

The reinforcing member 2 in the rear foot part 13 forms a connecting member that is inserted between the upper mid sole 1 and the lower mid sole 3 to thereby connect the upper and lower mid soles 1 and 3 together.

Holding Structure of Compression Deformation Member 30:

As shown in FIGS. 2A and 2B, the side surfaces of the compression deformation members 30 are substantially exposed so that they can be seen by the observer.

As shown in FIG. 3, the rear foot part 13 of the upper mid sole 1 forming the mid sole body is provided with a recessed portion 15 in which the rear foot blades 26*a* and 26*b* of the reinforcing member 2 and the compression deformation member 30 are placed. The recessed portion 15 is formed so as to gradually expand (increase depth) in the vertical direction from the middle of the rear foot part 13 toward the side surface or the back surface (the peripheral surface) of the upper mid sole 1.

The rear foot blades 26*a* and 26*b* of the reinforcing member 2 are each provided with an joined portion 27 to which the upper surface of the compression deformation member 30 is secured. As shown in FIG. 6B, in the position corresponding to the peripheral surface of the mid sole, a first engagement portion 28*c* is formed integrally with the joined portion 27 so as to extend downward from the joined portion 27. The first engagement portion 28*c* engages with the side surface of an upper portion of the compression deformation member 30. As shown in FIGS. 2A and 2B, the first engagement portion 28*c* forms a crescent-like shape as viewed from sideways, thus forming an upwardly-protruding (convexed) generally arch-like shape. The cross-sectional shape of the joined portion 27 of the holding member along the side surface or the back surface is an upwardly-protruding arch shape.

As an upper portion of the side surface of the compression deformation member 30 engages with the first engagement portion 28*c*, the compression deformation member 30 is prevented from popping out. Thus, the reinforcing member 2 forms a holding member for holding the compression deformation member 30.

The first engagement portion 28*c* is formed so as to cover only an upper edge of the compression deformation member, and is not formed in a loop shape. The first engagement portion 28*c* preferably covers an area smaller than the upper half of the compression deformation member 30 so that the first engagement portion 28*c* at least does not restrict the deformation of the lower portion of the compression deformation member 30.

As shown in FIG. 4, the shock-absorbing member (the lower mid sole body) 31 of each lower mid sole 3 is provided with a second engagement portion 32 that is rolling up in the upward direction at a position corresponding to the recessed portion 15 of the upper mid sole 1. As shown in FIG. 6B, the second engagement portion 32 engages with the side surface of a lower portion of the compression deformation member 30 to thereby prevent the compression deformation member 30 from popping out.

Thus, the upper portion and the lower portion of the side surface of the compression deformation member 30 are engaged with, and held by, the first engagement portion 28*c* of the reinforcing member 2 and the second engagement portion 32 of the lower mid sole body 31, respectively.

As shown in FIG. 6B, the outer sole 4 is provided with a third engagement portion 33 that is rolled up along the side surface of the lower mid sole body 31 below the second engagement portion 32. The third engagement portion 33 reinforces the second engagement portion 32 of the lower mid sole body 31. The third engagement portion 33 may engage directly with the compression deformation member 30, without providing the lower mid sole body 31 or without providing the second engagement portion 32.

Alternative Embodiments

Modifications

Figure 8A:
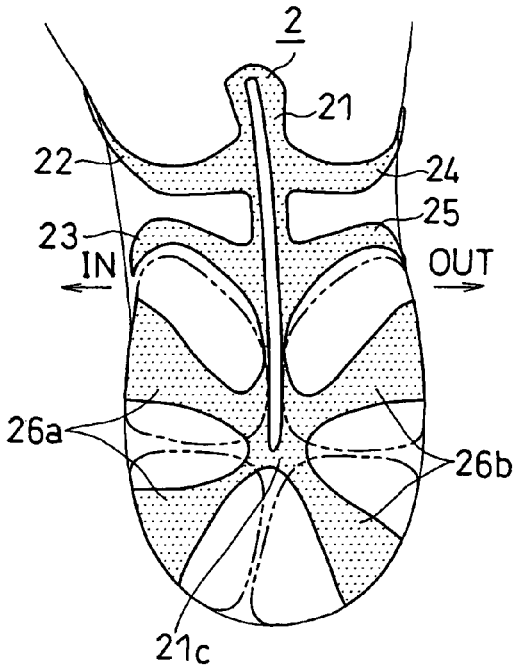
FIG. 8A is a bottom view showing a reinforcing member of the first embodiment.

The shape of the reinforcing member 2 is not limited to that shown in the first embodiment, but may be any of various shapes. Referring now to FIGS. 8B to 10C, alternative embodiments of the reinforcing member 2 will be described. Note that FIG. 8A shows the reinforcing member 2 of the first embodiment as a reference for the alternative embodiments to be described below.

Figure 8B:
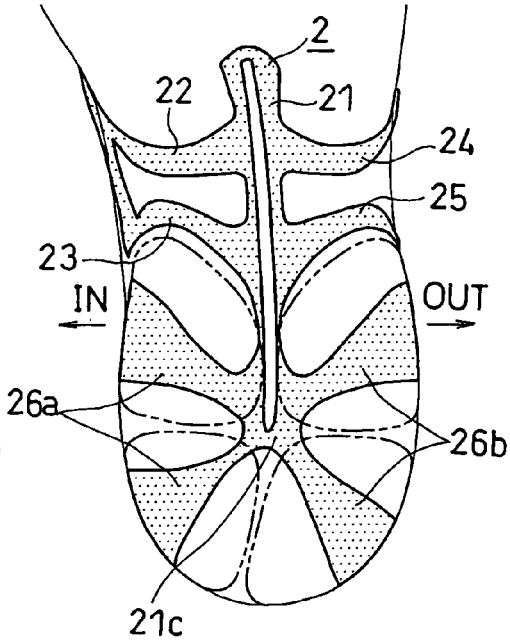
FIGS. 8B, 8C and 8D are bottom views each showing a reinforcing member of an alternative embodiment (modification).

FIG. 8B shows an alternative embodiment in which the medial edges of the two mid foot medial blades 22 and 23 are connected to each other. Thus, a loop is formed by the mid foot medial blades 22 and 23.

Figure 8C:
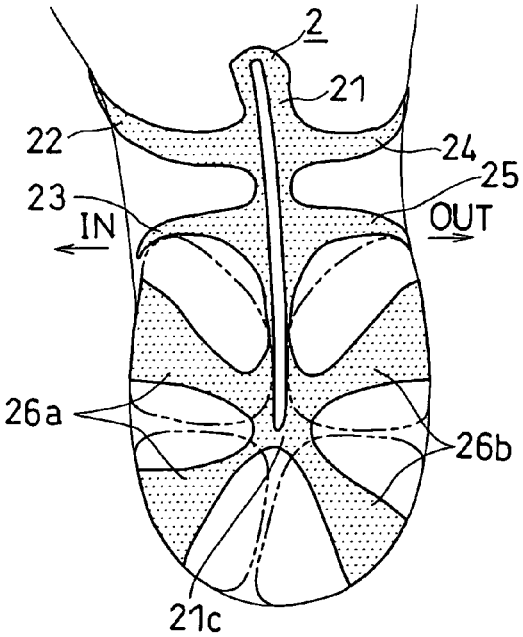

FIG. 8C shows an alternative embodiment in which the distance from the intersecting position between the front-side mid foot blades 22 and 24 and the main bar 21 to the intersecting position between the rear-side mid foot blades 23 and 25 and the main bar 21 is smaller than that in the first embodiment.

Figure 8D:
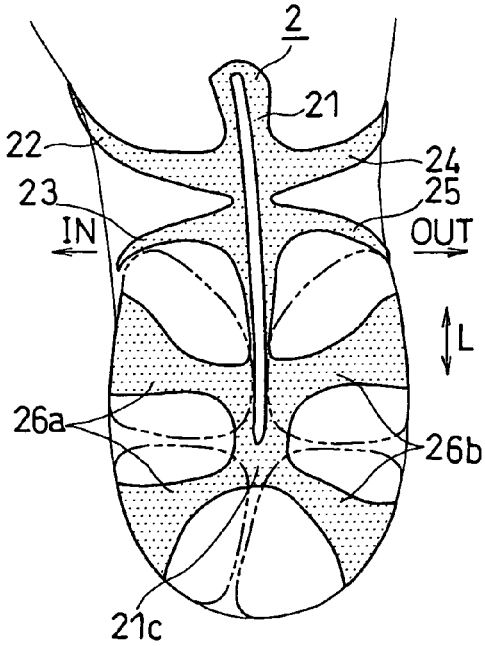

FIG. 8D shows an alternative embodiment in which the distance is further reduced from that of FIG. 8C, whereby the mid foot blades 22 to 25 are in a generally X-letter shape. In this alternative embodiment, the rear foot blades 26*a* and 26*b* do not extend radially, but are in a generally H-letter shape as viewed from above. In other words, the front-side rear foot blades 26*a* and 26*b* extend from a position in the main bar 21 that is frontward with respect to the base portion 21*c*.

While a total of four mid foot blades, including two medial ones and two lateral ones, are provided in the first embodiment, there may be five or more mid foot blades. Where there are two or more mid foot medial blades, the medial edges of any two or more of the mid foot medial blades may be connected to each other.

While the front-side mid foot blades 22 and 24 are bent in the frontward direction and the rear-side mid foot blades 23 and 25 are bent in the rearward direction in the first embodiment, the front-side and rear side mid foot blades may be bent generally in the same direction so that the front-side mid foot blades and the rear-side mid foot blades extend generally parallel to each other. The four mid foot blades may generally form a spiral pattern.

The lengths of the mid foot medial blades 22 and 23 may be less than or greater than those of the mid foot lateral blades 24 and 25.

Figure 9A:
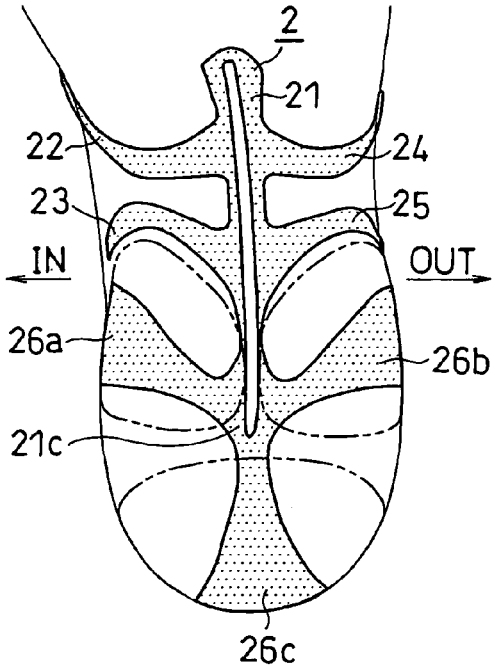
FIGS. 9A, 9B, 9C and 9D are bottom views each showing a reinforcing member of an alternative embodiment.

FIG. 9A shows an alternative embodiment in which there are three rear foot blades. This includes a rear foot medial blade 26*a*, a rear foot lateral blade 26*b*, and a rear foot blade 26*c* extending in the rearward (backward) direction.

Figure 9B:
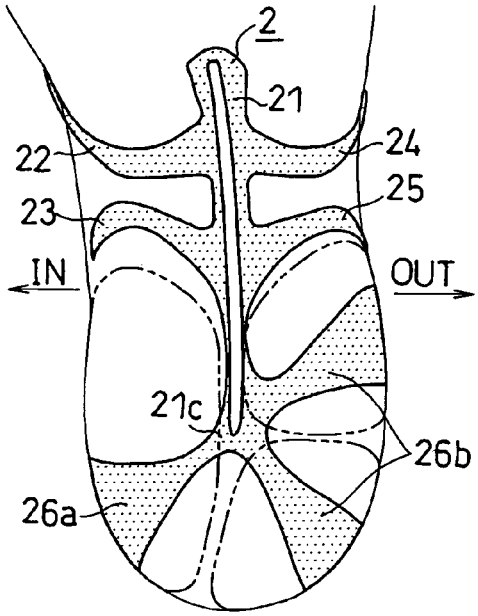

FIG. 9B shows an alternative embodiment in which there is no front-side rear foot medial blade, and there is only one, rear-side, rear foot medial blade 26*a*.

Figure 9C:
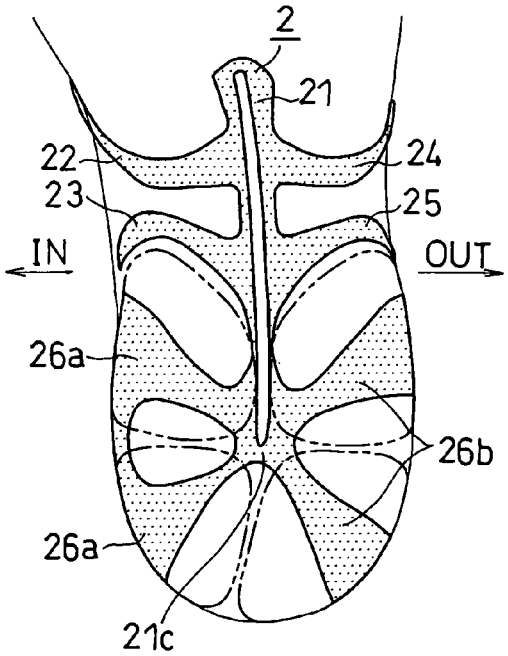

FIG. 9C shows an alternative embodiment in which the medial edges of the two rear foot medial blades 26*a* and 26*a* are connected to each other. Thus, a loop is formed by the rear foot medial blades 26*a* and 26*a*.

Figure 9D:
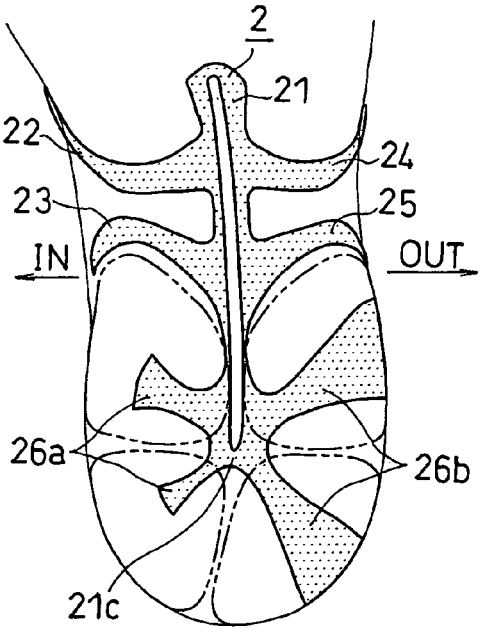

FIG. 9D shows an alternative embodiment in which the medial rear foot blades 26*a* and 26*a* are shorter than the lateral rear foot blades 26*b* and 26*b*.

There may be only one rear foot medial blades 26*a* and only one rear foot lateral blades 26*b*. In addition to the four rear foot blades 26*a* and 26*b* shown in the first embodiment, there may be another rear foot blade extending in the rearward (backward) direction.

There may be six or more rear foot blades extending radially from the base portion 21*c*.

A rear foot medial blade and a rear foot lateral blade do not have to be smoothly connected to each other in a straight line at the base portion 21*c*.

The rear foot blades may be formed in a spiral pattern that is centered about the base portion 21*c*.

Figure 10A:
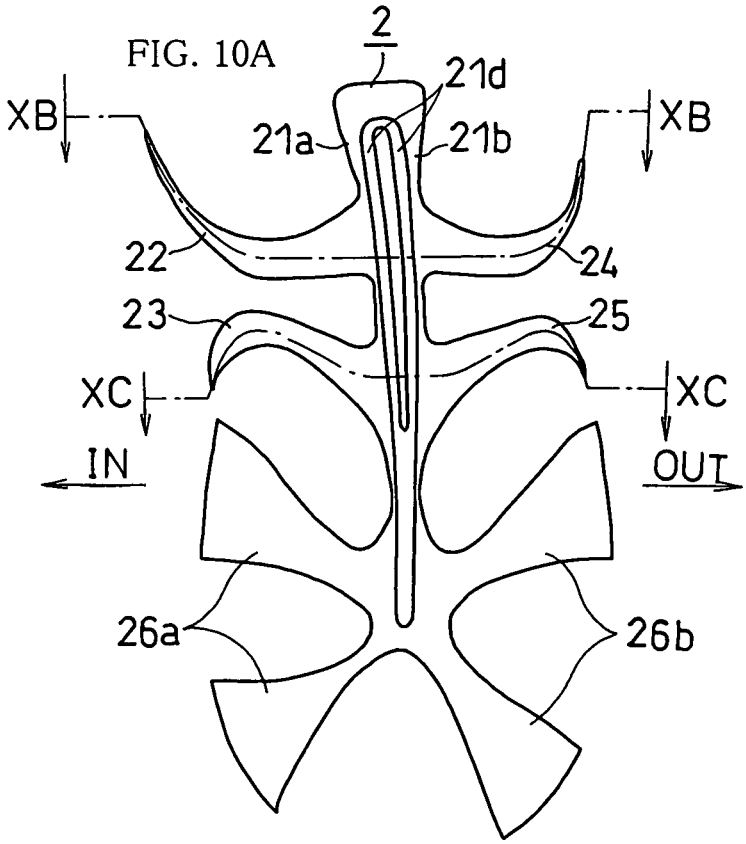
FIG. 10A is a bottom view showing a reinforcing member of an alternative embodiment.
Figure 10B:
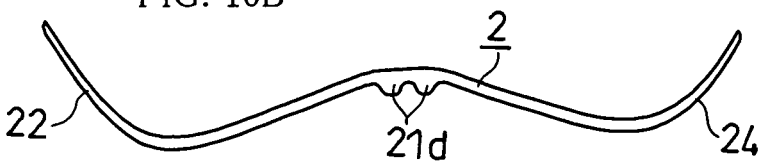
FIG. 10B is a cross-sectional view taken along line XB-XB in FIG. 10A.
Figure 10C:
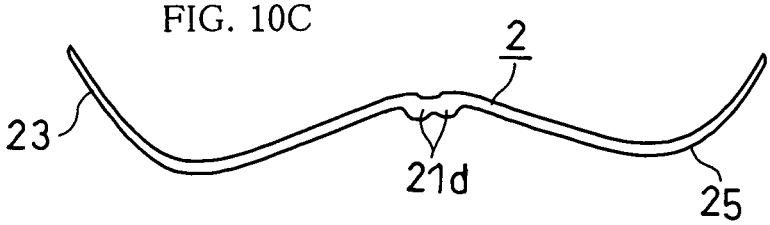
FIG. 10C is a cross-sectional view taken along line XC-XC in FIG. 10A.

FIGS. 10A to 10C show an alternative embodiment in which the reinforcing member 2 is provided with two rod-shaped portions 21*d* in the mid foot part. In this case, the structure is less easily bent than in a case where there is only one rod-shaped portion, thus improving the function to suppress the lowering the arch.

Second Embodiment

A second embodiment will now be described with reference to FIG. 11A to FIG. 13B. In this and subsequent embodiments, like elements to those of the first embodiment are denoted by like reference numerals and will not be further described below.

Figure 11A:
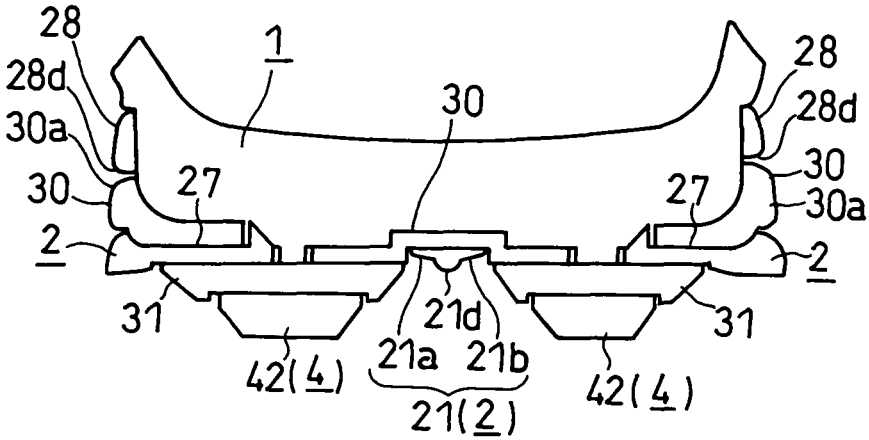
Figure 11B:
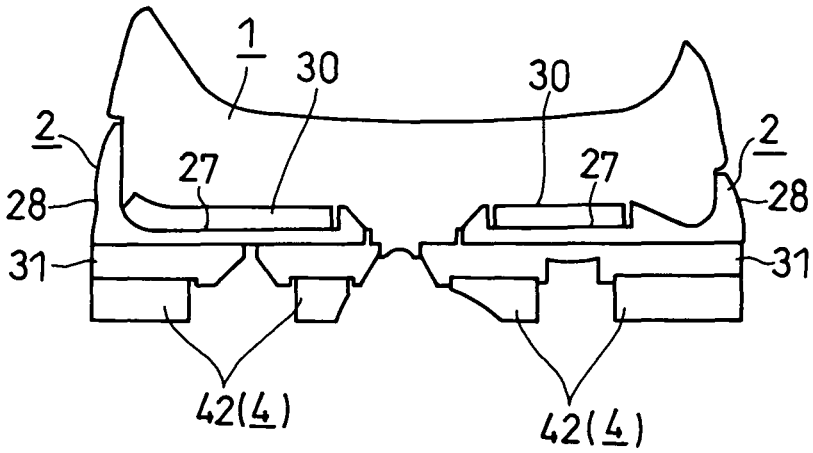

As shown in FIGS. 11A and 11B, the compression deformation member 30 in the rear foot part is held between the upper mid sole 1 and the reinforcing member 2 in the present embodiment. The joined portion 27, to which the lower surface of the compression deformation member 30 is secured, is formed on the upper surface of the reinforcing member (the holding member) 2.

Figure 12:
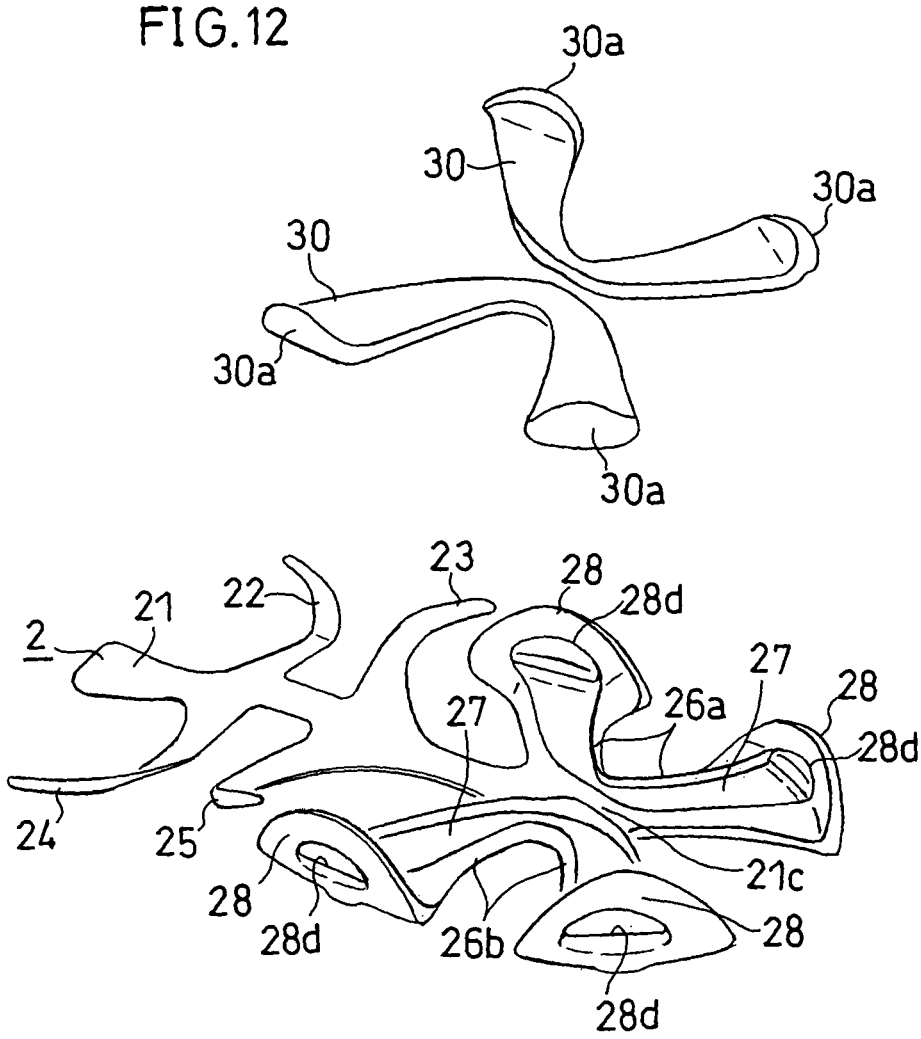
FIG. 12 is an exploded perspective view of a reinforcing member and a compression deformation member, as viewed from the upper side.

As shown in FIG. 12, in the present embodiment, there are a pair of compression deformation members 30, each being formed in a generally V-letter shape. The pair of compression deformation members 30, are arranged generally in symmetry. The joined portion 27 is also formed in a generally V-letter shape conforming to the shape of the compression deformation member 30.

Figure 13A:
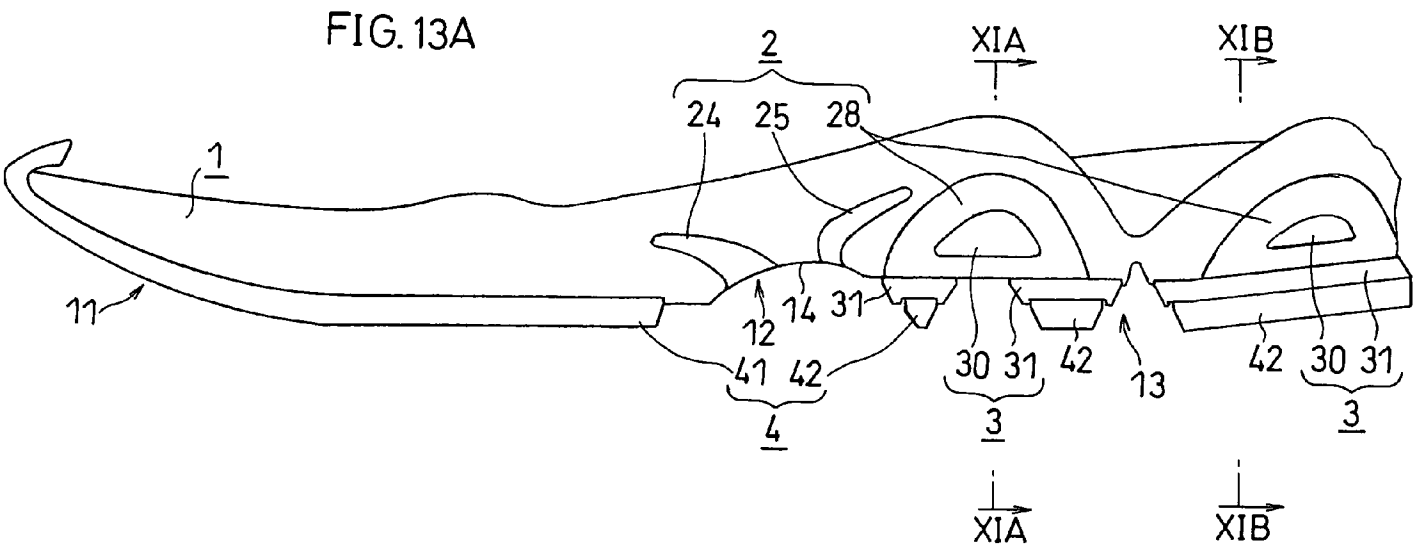
FIG. 13A is a lateral side view of the shoe sole.
Figure 13B:
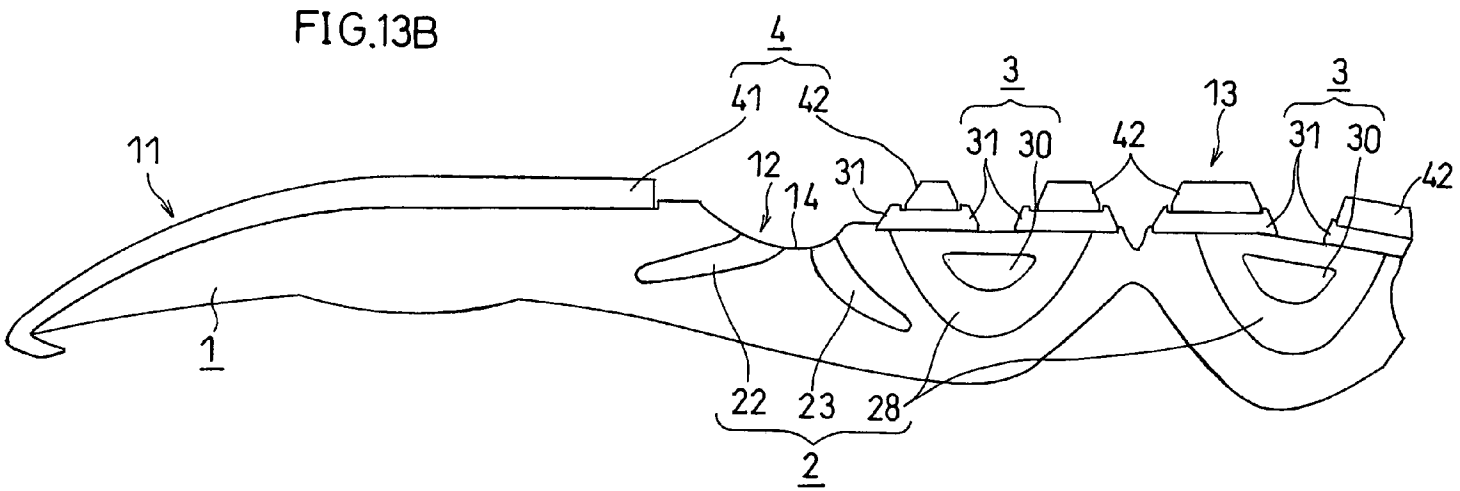
FIG. 13B is a medial side view of the shoe sole.
Figure 14:
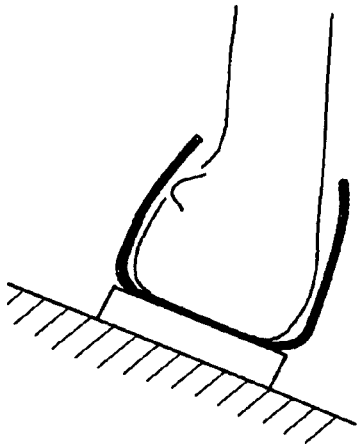
FIG. 14 is a schematic cross-sectional view showing how the rear foot part of a conventional shoe sole contacts the ground on a slope.

The rear foot blades 26*a* and 26*b* of the reinforcing member 2 are each provided with the roll-up portion 28 extending upward from the joined portion 27. The roll-up portion 28 engages with an edge 30*a* of the compression deformation member 30 to thereby prevent the compression deformation member 30 from popping out. The roll-up portion 28 includes an engagement hole 28*d* to be engaged with the edge 30*a* of the compression deformation member 30. With such engagement holes 28*d*, the edges 30*a* of the compression deformation members 30 are exposed so that the edges 30*a* can be seen by the observer, as shown in FIGS. 13A and 13B, while allowing for the deformation of the compression deformation member 30.

Third Embodiment

Next, a third embodiment will be described with reference to FIGS. 15A and 15B.

Figure 15A:
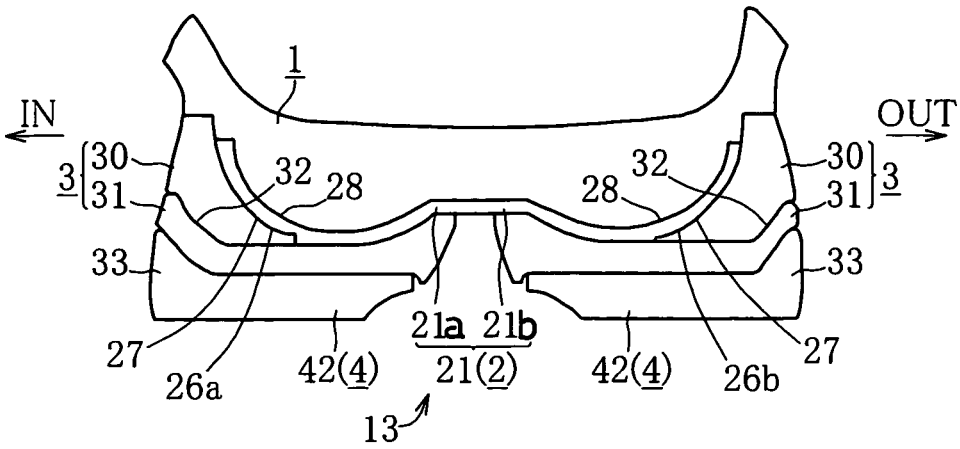
Figure 15B:
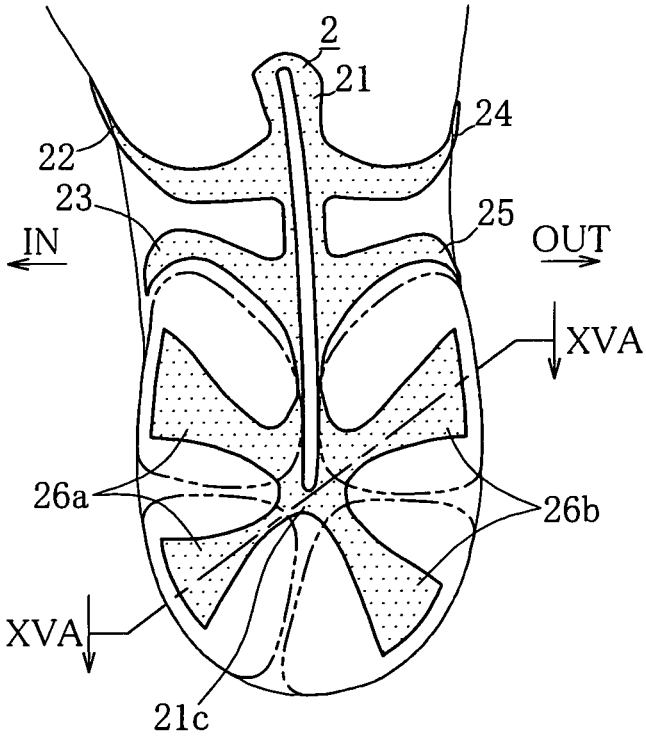

As shown in FIGS. 15A and 15B, in the present embodiment, as opposed to the first embodiment, the rear foot blades 26*a* and 26*b* do not reach the side surface of the mid sole, whereby the edges of the rear foot blades 26*a* and 26*b* are not exposed on the side surface of the mid sole, and there is no first engagement portion.

On the side surface of the mid sole where the compression deformation member 30 is exposed, and in the vicinity thereof, the compression deformation member 30 is sandwiched between the upper and lower mid sole bodies 1 and 31. On the other hand, in areas where the rear foot blades 26*a* and 26*b* extend, the compression deformation member 30 is sandwiched and held between the holding member (reinforcing member) 2 and the lower mid sole body 31.

In the present embodiment, the outer sole 4 is rolled up along the side surface of the second engagement portion 32 of the lower mid sole body 31 to thereby form the third engagement portion 33, as shown in FIG. 15A. Thus, the third engagement portion 33 indirectly engages with the side surface of a lower portion of the compression deformation member 30 via the second engagement portion 32 of the lower mid sole body 31 therebetween, thereby preventing the second engagement portion 32 and the compression deformation member 30 from popping out.

As an alternative embodiment (modification) to the present embodiment, the outer sole 4 may be joined directly to the compression deformation member 30 without providing the lower mid sole body 31 of a foam such as an EVA or a PU. In such a case, the compression deformation member 30 is sandwiched and held between the outer sole 4 and the upper mid sole body 1 or the holding member 2, and the third engagement portion 33 engages directly with the compression deformation member 30. Such a structure is also applicable to the first embodiment.

With such an alternative embodiment, however, a portion of the holding member 2, which is harder than the lower mid sole body 31 of a foam such as an EVA or a PU, is directly bonded on the outer sole 4. Therefore, the deformation of the outer sole 4 being in contact with the road surface is reduced, whereby there may be a louder sound upon landing due to the contact between the outer sole 4 and the holding member 2 and the ground contact area of the outer sole 4 may be reduced, as compared with a case where the lower mid sole body 31 is provided. This also creates a different feel when worn than that of ordinary athletic shoes, and some wearers may feel awkward.

In contrast, the present embodiment and the first embodiment provide the lower mid sole body 31, which is relatively soft, between the holding member 2 and the outer sole 4, whereby the holding member 2 and the outer sole 4 are not in direct contact with each other. This reduces such problems as the louder sound upon landing, the smaller ground contact area of the outer sole, or the awkwardness felt by the wearer.

While preferred embodiments have been described above with reference to the drawings, various obvious changes and modifications will readily occur to those skilled in the art upon reading the present specification.

For example, the upper mid sole may be divided into two or more portions.

The main bar may include no rod-shaped portion.

Such changes and modifications shall be deemed to fall within the scope of the present invention.

INDUSTRIAL APPLICABILITY

The present invention can be applied to various kinds of shoes.

What is claimed is:

1. A shoe sole comprising a mid sole underlying a foot sole, and an outer sole attached to a lower surface of the mid sole, wherein:

the outer sole contacts a ground;

the mid sole includes a mid sole body of a resin foam, and a compression deformation member that is exposed on a side surface or a back surface of the mid sole;

a holding member is provided for holding the compression deformation member at a predetermined position in cooperation with the mid sole body or the outer sole, the holding member including a main bar and a plurarity of blades comprising a mid foot medial blade, a mid foot lateral blade, and rear blades, the mid foot medial blade curvedly extending from a medial portion of the main bar and the mid foot lateral blade curvedly extending from a lateral portion of the main bar;

the holding member includes a joined portion secured to an upper surface or a lower surface of the compression deformation member, and a first engagement portion extending on the side surface or the back surface of the mid sole from the joined portion in an upward direction or a downward direction; and the first engagement portion engages with the compression deformation member to prevent the compression deformation member from popping out, the mid sole body includes a recessed portion, wherein a height of the recessed portion in a vertical direction gradually increases from a center of a fore foot part of the mid sole with respect to a front-rear direction and a medial-lateral direction or a middle of the rear foot part with respect to the front-rear direction and the medial-lateral direction toward the side surface or the back surface;

the compression deformation member is located in the recessed portion; and the joined portion of the holding member is secured to a lower surface of the recessed portion of the mid sole body, and the first engagement portion extends downward from the joined portion to engage with an upper portion of an edge of the compression deformation member, the mid sole body includes an upper mid sole body including the recessed portion, and a lower mid sole body located below the upper mid sole body;

the compression deformation member is sandwiched between the holding member and the lower mid sole body;

the lower mid sole body includes a second engagement portion that is rolled upward at an edge of the recessed portion on the side surface or the back surface; and the second engagement portion engages with the compression deformation member to prevent the compression deformation member from popping out.

2. A shoe sole, comprising a mid sole underlying a foot sole, and an outer sole attached to a lower surface of the mid sole, wherein the outer sole contacts a ground, wherein:

the mid sole includes a mid sole body of a resin foam, and a compression deformation member that is exposed on a side surface or a back surface of the mid sole;

a holding member is provided for holding the compression deformation member at a predetermined position in cooperation with the mid sole body or the outer sole, the holding member comprising a main bar and a plurality of blades including a medial blade, a lateral blade, and rear blades, the medial blade curvedly extending from a medial portion of the main bar and the lateral blade curvedly extending from a lateral portion of the main bar;

the holding member includes a joined portion secured to an upper surface of the compression deformation member;

the mid sole body includes a recessed portion, wherein a height of the recessed portion in a vertical direction gradually increases from a center of a fore foot part of the mid sole with respect to a front-rear direction and a medial-lateral direction or a middle of the rear foot part with respect to the front-rear direction and the medial-lateral direction toward the side surface or the back surface;

the compression deformation member is located in the recessed portion;

the joined portion of the holding member is secured to a lower surface of the recessed portion of the mid sole body;

the mid sole body includes an upper mid sole body including the recessed portion, and a lower mid sole body located below the upper mid sole body; and the compression deformation member is sandwiched between the holding member and the lower mid sole body.

3. A shoe sole according to claim 2, wherein:

the lower mid sole body includes an engagement portion that is rolled upward at an edge of the recessed portion on the side surface or the back surface; and the engagement portion engages with the compression deformation member to prevent the compression deformation member from popping out.

4. A shoe sole according to claim 2, wherein:

the outer sole includes an engagement portion that is rolled upward at an edge of the recessed portion on the side surface or the back surface; and the engagement portion directly or indirectly engages with the compression deformation member to prevent the compression deformation member from popping out.

* * * * *